US008065987B2

(12) United States Patent
Yang

(10) Patent No.: US 8,065,987 B2
(45) Date of Patent: Nov. 29, 2011

(54) INTEGRATED ENGINE BRAKE WITH MECHANICAL LINKAGE

(76) Inventor: Zhou Yang, Oak Ridge, NC (US)

( * ) Notice: Subject to any disclaimer, the term of this patent is extended or adjusted under 35 U.S.C. 154(b) by 0 days.

(21) Appl. No.: 12/348,320

(22) Filed: Jan. 5, 2009

(65) Prior Publication Data

US 2010/0170472 A1 Jul. 8, 2010

(51) Int. Cl.
*F02D 13/04* (2006.01)
*F01L 1/34* (2006.01)

(52) U.S. Cl. ..... 123/321; 123/90.16; 123/90.46

(58) Field of Classification Search ..... 123/90.12, 123/90.15–90.18, 90.39–90.59, 320–323
See application file for complete search history.

(56) References Cited

U.S. PATENT DOCUMENTS

| | | | | |
|---|---|---|---|---|
| 6,234,143 | B1 * | 5/2001 | Bartel et al. | 123/321 |
| 6,253,730 | B1 * | 7/2001 | Gustafson | 123/321 |
| 6,594,996 | B2 * | 7/2003 | Yang | 60/602 |
| 6,920,868 | B2 * | 7/2005 | Ruggiero et al. | 123/568.14 |
| RE39,258 | E * | 9/2006 | Cosma et al. | 123/321 |
| 7,556,004 | B2 * | 7/2009 | Wiley et al. | 123/90.39 |
| 7,559,300 | B2 * | 7/2009 | Ruggiero | 123/90.12 |
| 7,673,600 | B2 * | 3/2010 | Yang | 123/90.16 |
| 7,984,705 | B2 * | 7/2011 | Yang | 123/321 |
| 2005/0211206 | A1 * | 9/2005 | Ruggiero et al. | 123/90.16 |
| 2007/0095312 | A1 * | 5/2007 | Vanderpoel et al. | 123/90.16 |
| 2007/0144472 | A1 * | 6/2007 | Yang | 123/90.16 |
| 2010/0037854 | A1 * | 2/2010 | Yang | 123/321 |
| 2010/0065019 | A1 * | 3/2010 | Yang | 123/321 |

* cited by examiner

*Primary Examiner* — Mahmoud Gimie
*Assistant Examiner* — David Hamaoui
(74) *Attorney, Agent, or Firm* — Squire, Sanders & Dempsey (US) LLP

(57) ABSTRACT

Apparatus and method are disclosed for converting an internal combustion engine from a normal engine operation (20) to an engine braking operation (10). The engine includes exhaust valve train components comprising at least one exhaust valve (300) and at least one cam (230) for cyclically opening and closing the at least one exhaust valve (300). The apparatus comprises actuation means (100) having at least one component integrated into at least one of the exhaust valve train components, such as a rocker arm (210) or a valve bridge (400). The actuation means (100) has an inoperative position and an operative position. In the inoperative position, the actuation means (100) is retracted and the small braking cam lobes (232 & 233) are skipped to generate a main valve lift profile (220*m*) for the normal engine operation (20). In the operative position, the actuation means (100) is extended to form a mechanical linkage so that the motion from all the cam lobes (220, 232 & 233) is transmitted to the at least one exhaust valve (300) for the engine braking operation (10). The apparatus further comprises control means (50) for moving the actuation means (100) between the inoperative position and the operative position to achieve the conversion between the normal engine operation (20) and the engine braking operation (10). The apparatus also includes valve lash adjusting mechanism, oil retraining means (350), and engine brake reset means (150).

15 Claims, 18 Drawing Sheets

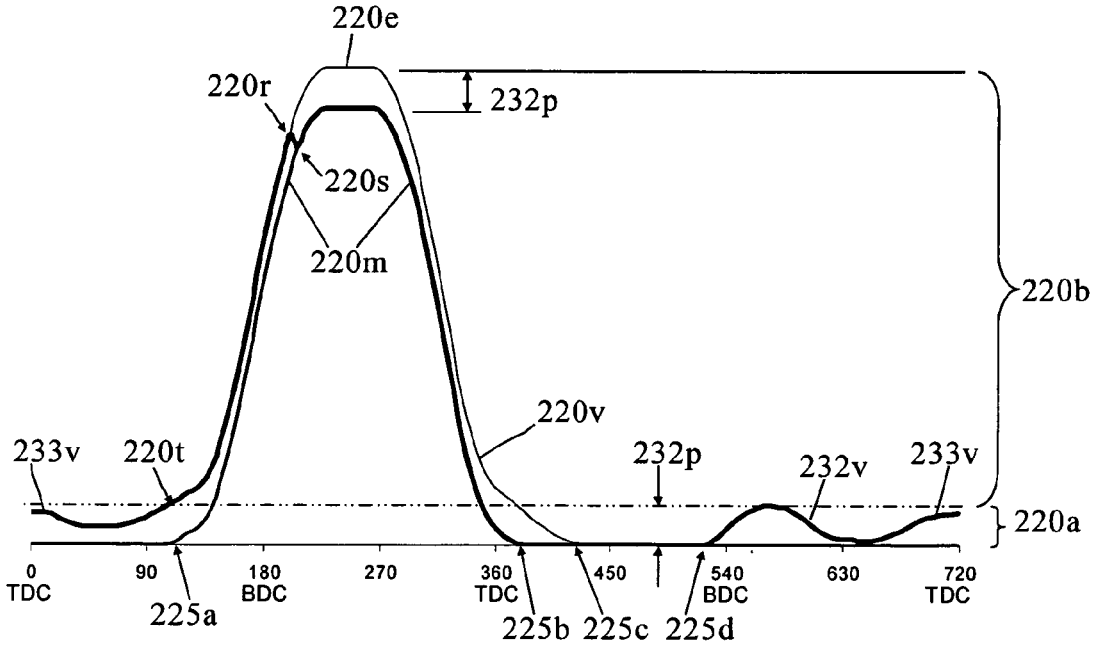
FIG. 6
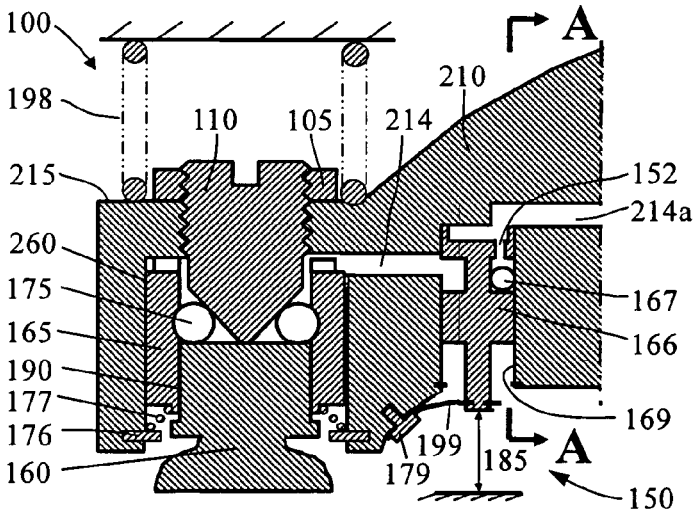
FIG. 7
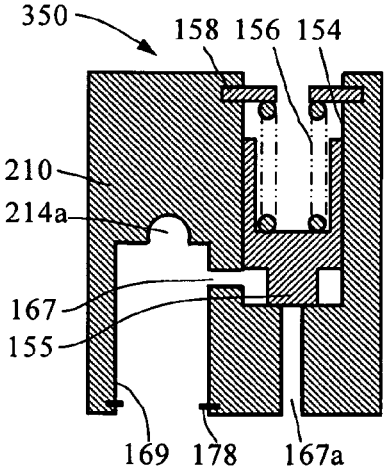
FIG. 7A-A

INTEGRATED ENGINE BRAKE WITH MECHANICAL LINKAGE

BACKGROUND OF THE INVENTION

1. Field of Invention

The present invention relates generally to the braking of an internal combustion engine, specifically to engine braking apparatus integrated in the engine exhaust valve train.

2. Prior Art

It is well known in the art to employ an internal combustion engine as brake means by, in effect, converting the engine temporarily into a compressor. It is also well known that such conversion may be carried out by cutting off the fuel and opening the exhaust valve(s) at or near the end of the compression stroke of the engine piston. By allowing compressed gas (typically, air) to be released, energy absorbed by the engine to compress the gas during the compression stroke is not returned to the engine piston during the subsequent expansion or "power" stroke, but dissipated through the exhaust and radiator systems of the engine. The net result is an effective braking of the engine.

An engine brake is desirable for an internal combustion engine, particularly for a compression ignition type engine, also known as a diesel engine. Such engine offers substantially no braking when it is rotated through the drive shaft by the inertia and mass of a forward moving vehicle. As vehicle technology has advanced, its hauling capacity has increased, while at the same time rolling and wind resistances have decreased. Accordingly, there is a heightened braking need for a diesel-powered vehicle. While the normal drum or disc type wheel brakes of the vehicle are capable of absorbing a large amount of energy over a short period of time, their repeated use, for example, when operating in hilly terrain, could cause brake overheating and failure. The use of an engine brake will substantially reduce the use of the wheel brakes, minimize their wear, and obviate the danger of accidents resulting from brake failure.

There is also a desire to use an engine brake when shifting gears in the gearbox of the vehicle. This is apt to be an even more important aspect in commercial vehicles such as trucks and buses that are ever more frequently equipped with automatic or semi-automatic gearboxes. Such gearboxes can be likened to conventional manual gearboxes, with the difference being that the shifting of gears is carried out by means of a control device, instead of manually by the driver. In order to reduce loss of driving power of the engine during up-shift, it is an advantage if the engine speed can be matched to the new gear ratio as soon as possible. It is known to selectively introduce an engine brake during an up-shift when certain operating parameters are obtained, in order to achieve a rapid decrease of engine speed during the gear shifting process. In this way, it is alleged that wear on the engine brake system is decreased since the introduction of the engine brake only takes place during a small part of the total amount of the up-shift process.

There are different types of engine brakes. Typically, an engine braking operation is achieved by adding an auxiliary engine valve event called an engine braking event to the normal engine valve event. Depending on how the engine valve event is produced, an engine brake can be defined as:

(a) Type I engine brake—the engine braking event is produced by importing motions from a neighboring cam, which generates the so called Jake brake;

(b) Type II engine brake—the engine braking event is produced by altering existing cam profile, which generates a lost motion type engine brake;

(c) Type III engine brake—the engine braking event is produced by using a dedicated cam for engine braking, which generates a dedicated cam (rocker) brake;

(d) Type IV engine brake—the engine braking event is produced by modifying the existing engine valve lift, which normally generates a bleeder type engine brake;

(e) Type V engine brake—the engine braking event is produced by using a dedicated valve train for engine braking, which generates a dedicated valve (the fifth valve) engine brake.

The engine brake can also be divided into two big categories, i.e., the compression release engine brake (CREB) and the bleeder type engine brake (BTEB). Here, the focus is the compression release engine brakes.

Conventional compression release engine brakes open the exhaust valve(s) at or near the end of the compression stroke of the engine piston (also known as top dead center or TDC). They typically include hydraulic circuits for transmitting a mechanical input to the exhaust valve(s) to be opened. Such hydraulic circuits typically include a master piston that is reciprocated in a master piston bore by a mechanical input from the engine. Hydraulic fluid in the circuit transmits the master piston motion to a slave piston in the circuit, which in turn, reciprocates in a slave piston bore in response to the flow of hydraulic fluid in the circuit. The slave piston acts either directly or indirectly on the exhaust valve(s) to be opened during the engine braking.

An example of a prior art CREB is provided by the disclosure of Cummins, U.S. Pat. No. 3,220,392, which is hereby incorporated by reference. Engine braking systems based on the patent have enjoyed great commercial success. However, the prior art engine braking system is a bolt-on accessory that fits above the overhead. In order to provide space for mounting the braking system, a spacer may be positioned between the cylinder head and the valve cover that is bolted to the spacer. This arrangement may add unnecessary height, weight, and costs to the engine. Many of the above-noted problems result from viewing the braking system as an accessory to the engine rather than as part of the engine itself.

As the market for compression release-type engine brakes (CREB) has developed and matured, there is a need for design systems that reduce the weight, size and cost of such retarding systems, and improve the inter-relation of various ancillary equipments, such as the turbocharger and the exhaust brake with the retarding system. In addition, the market for compression release engine brakes has moved from the aftermarket, to original equipment manufacturers. Engine manufacturers have shown an increased willingness to make design modifications to their engines that would increase the performance and reliability and broaden the operating parameters of the compression release-type engine brake.

(a) Earlier Integrated Rocker Brake

One possible solution is to integrate components of the braking system with the rest of the engine components. One attempt at integrating parts of the compression braking system is found in U.S. Pat. No. 3,367,312 to Jonson, which discloses an engine braking system including a rocker arm having a plunger, or piston, positioned in a cylinder integrally formed in one end of the rocker arm wherein the plunger can be locked in an outer position by hydraulic pressure to permit braking system operation. Jonson also discloses a spring for biasing the plunger outward from the cylinder into continuous contact with the exhaust valve to permit the cam-actuated rocker lever to operate the exhaust valve in both the power and braking modes. A control valve is used to control the flow of pressurized fluid to the rocker arm cylinder so as to permit selective switching between braking operation and normal power operation.

However, the control valve unit of Jonson's compression braking system is positioned separately from the rocker arm assembly, resulting in unnecessarily long fluid delivery passages and a longer response time. This also leads to an unnecessarily large amount of oil that must be compressed before activation of the braking system can occur, resulting in large compliance and less control over the timing of the compression braking. Moreover, the control valve is a manually operated rotary type valve requiring actuation by the driver often resulting in unreliable and inefficient braking operation. Also, rotary valves are subject to undesirable fluid leakage between the rotary valve member and its associated cylindrical bore.

(b) Integrated Rocker Brake with Two-Valve Opening for Engine Braking

Another integrated engine braking system for commercial vehicles is known from U.S. Pat. No. 5,564,385 ("the '385 patent") in which a stroke-limited hydraulic piston is arranged at the operating end of a rocker arm for taking up valve play in the valve mechanism of the engine. A pressure regulating valve is utilized for supplying pressurized oil to the hydraulic piston for taking up valve play in the rocker arm. The oil is supplied to the rocker arm by means of a canal, which is provided with an exhaust in the shape of a very narrow hole through which oil can flow, and in this way be made to affect the valve body to, depending on operation, be positioned in any of the predetermined positions. For this purpose, the control valve is also provided with an adjustable magnet valve arranged for drainage of oil that has been fed through the narrow hole.

Although the engine brake system disclosed in the '385 patent has enjoyed considerable commercial success, it has some drawbacks. One of the drawbacks is that it includes a small and carefully defined hole for the transport of oil, which causes a high sensitivity to clogging and tolerances. In addition, this previously known valve causes a relatively slow coupling and de-coupling, which is particularly noticeable in connection with gear shifting. Also, the design is sensitive to external disturbances, for example in the form of temperature changes and pollution such as, for example, dirt particles or coatings.

Another drawback is related to the hydraulic actuation of the engine brake system, which inherits with high compliance. High compliance leads to large valve lift deflection, which leads to increased valve load. And increased valve load leads back to higher compliance. In order to reduce hydraulic compliance, the hydraulic piston must be designed with a large diameter. The large diameter hydraulic piston takes a long time to attain its extended position. Therefore the system taught by the '385 patent is not suitable for use in reducing engine speed at an up-shift.

Another problem with such prior art engine brakes is that the normal operation of the exhaust valve is affected during brake operation. Clearance between the cam follower and camshaft is effectively reduced during brake operation. This means that the first lobe on the camshaft opens the exhaust valve further than normal for the exhaust stroke during engine brake operation. In some cases it is necessary to provide recesses in the pistons so that the exhaust valves do not strike the pistons when the brake is operational. These recesses, and the abnormally extended exhaust valves, interfere with optimal engine design from the point of view of other considerations such as emission controls.

An additional disadvantage of the know arrangement is that it does not have an easy way or a proper lash adjusting means to set the valve lash.

(c) Integrated Rocker Brake with One-Valve Opening for Engine Braking

Instead of opening two exhaust valves during engine braking, U.S. Pat. No. 6,234,143 ("the '143 patent") discloses an integrated rocker brake with one-valve opening for engine braking. An engine brake actuator is disposed in the rocker arm between the pivot point and the distal end. The rocker arm and the valve bridge of the engine are so arranged that the hydraulic or braking piston of the brake actuator is able to actuate on the inner valve near the pivot point of the rocker arm. By actuating only one exhaust valve, the engine braking load is greatly reduced.

The integrated engine brake system, however, has the following drawbacks. First, after the braking valve is lifted by the brake piston, the valve bridge is tilted and the followed normal valve actuation on both the braking valve and non-braking valve by the rocker arm is asymmetric or unbalanced. Large side load could be experienced on both valve stems or on the valve bridge guide if the bridge is guided. Second, the brake system can only fit on a particular type of engines that have the "parallel" arrangement of the rocker arm and the valve bridge.

(d) Integrated Rocker Brake with Reset Valve

U.S. Pat. No. 6,253,730 ("the '730 patent") discloses an integrated rocker brake with a reset valve trying to avoid the asymmetric loading on the valves or the valve bridge caused by the engine braking operation as disclosed by the '143 patent. The reset valve will reset or retract the hydraulic piston in the rocker arm before the braking valve reaches its peak braking lift so that the braking valve will return back to its seat before the main valve lift event starts, and the rocker arm can act on the leveled valve bridge and open both the braking valve and the non-braking valve without any asymmetric loading.

However, resetting the braking valve lift around the compression TDC is very problematic. First, the duration and magnitude of the valve lift for engine braking is very small and even smaller for resetting. Second, the resetting happens at around the peak engine braking load and causes high pressure or large load on the reset valve. The timing for the resetting is critical. If the resetting happens too soon, there will be too much braking valve lift loss (lower lift and earlier closing) and lower braking performance. If the resetting happens too late, the braking valve will not be able to close before the main valve event starts and cause asymmetric loading. Therefore, the integrated rocker engine brake according to the '730 patent may not work well at high engine speeds when the reset duration and height is extremely small and the braking load or pressure on the reset valve is very high.

It is clear from the above description that the prior-art engine brake systems have one or more of the following drawbacks:

(a) The system can only be installed on a particular type of engines.

(b) The system has slow response (on & off) time.

(c) The system is hydraulically driven and has large compliance resulting in high braking load.

(d) The system causes asymmetric loading on valves or valve bridge guide.

(e) The system has too many parts, high complexity, and not work well at high engine speeds.

(f) The system has no easy way to set lash for engine braking valves.

(g) The system is not reliable and sensitive to external disturbances.

(h) The system affects normal engine performance (efficiency and emission).

SUMMARY OF THE INVENTION

The engine braking apparatus of the present invention addresses and overcomes the foregoing drawbacks of prior art engine braking systems.

One object of the present invention is to provide an engine braking apparatus that can be installed on all types of engines.

Another object of the present invention is to provide an engine braking apparatus that has fast response (on and off) time.

Still another object of the present invention is to provide an engine braking apparatus with fewer components, reduced complexity, lower cost, and increased system reliability.

A further object of the present invention is to provide such an engine braking apparatus that contains a braking valve lash adjusting mechanism so that it does not increase the manufacturing tolerance requirements of many of the components.

Still a further object of the present invention is to provide an engine braking apparatus that is effective at all engine speeds and not sensitive to external disturbances.

Yet a further object of the present invention is to provide engine brake actuation means that transmit force, or the engine braking load, through mechanical linkage means that does not have high compliance and overloading problems associated with traditional hydraulic means used by prior art engine braking systems.

Still another object of the present invention is to provide an engine braking apparatus that will not affect the normal engine operation.

The engine braking apparatus of the present invention converts an internal combustion engine from a normal engine operation to an engine braking operation. The engine includes exhaust valve train components containing at least one exhaust valve and at least one cam for cyclically opening and closing the at least one exhaust valve.

The apparatus includes an engine brake actuation means having at least one component integrated into at least one of the exhaust valve train components, such as the rocker arm or the valve bridge. The actuation means has an inoperative position and an operative position. In the inoperative position, the actuation means is retracted and disengaged from the normal engine operation. In the operative position the actuation means is extended to form a mechanical linkage for opening the at least one exhaust valve for the engine braking operation. The apparatus also has an engine brake control means for moving the engine brake actuation means between the inoperative position and the operative position to achieve the conversion between the normal engine operation and the engine braking operation.

The actuation means further includes mechanical linkage means for transmitting load generated by engine braking operation. The mechanical linkage means includes at least one system selected from the group consisting of: a piston-sliding device, a ball-locking device, and a piston-coupling device.

The apparatus also includes a reset means for moving the actuation means from the operative position to the inoperative position during the higher portion of the valve lift profile so that the valve lift profile is reset to a smaller profile.

The engine braking apparatus according to the embodiments of the present invention have many advantages over the prior art engine braking systems, such as faster response; better performance, fewer components, reduced complexity, and lower cost.

BRIEF DESCRIPTION OF THE DRAWINGS

These and other advantages of the present invention will become more apparent from the following description of the preferred embodiments in connection with the following figures.

FIG. 6 has exhaust valve lift profiles according to one version of the present invention.

FIG. 7 is a schematic diagram of an engine braking apparatus with a reset means.

FIG. 7A-A shows a cross section of the reset means in FIG. 7.

DETAILED DESCRIPTION OF THE PREFERRED EMBODIMENTS

Reference will now be made in detail to presently preferred embodiments of the invention, examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1:
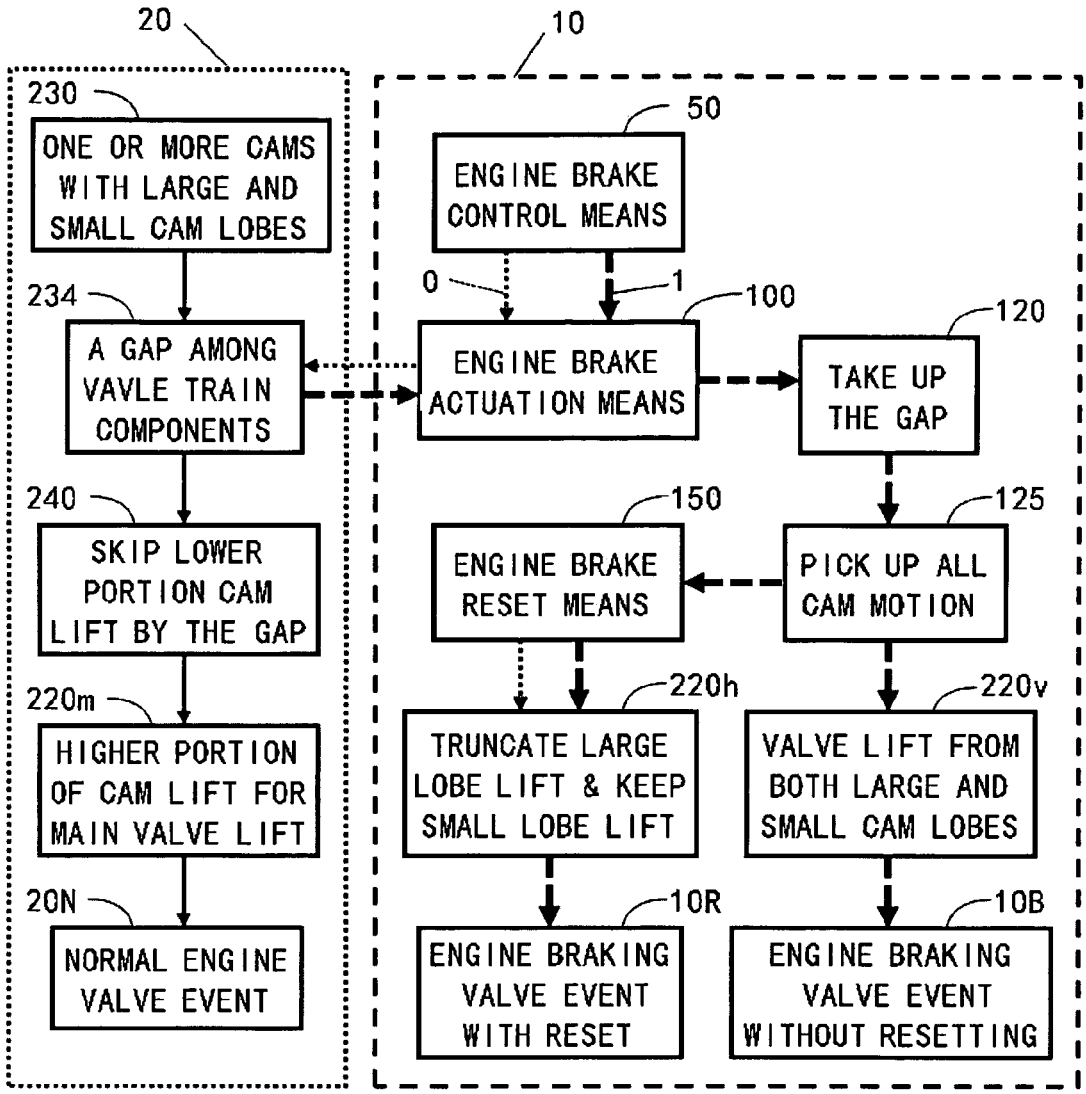
FIG. 1 is a function chart showing relationship between a normal engine operation and an added engine braking operation according to one version of the present invention.

FIG. 1 is a function chart illustrating the general relationship between the normal engine operation 20 and the added engine braking operation 10 according to one version of the present invention. For the normal engine operation 20, the small cam lobe(s) on the exhaust cam 230 are skipped, as shown in block 240, due to a gap 234 among the valve train components, to produce the main exhaust valve lift profile 220*m* for the normal engine valve event 20N. For the engine braking operation 10, the engine brake control means 50 controls the motion of the engine brake actuation means 100 between an inoperative position 0 and an operative position 1. At the inoperative position 0, the actuation means 100 retracts to form the gap 234, while at the operative position 1 (the control means 50 is turned on), the actuation means 100 extends to take up the gap 234 as shown in block 120. Without the gap 234, motion from all the cam lobes, small and large, is picked up by the rocker arm as shown in block 125. The braking valve lift profile, however, depends on whether there is an engine brake reset means 150.

If there is no engine brake reset means, motion from all the cam lobes will be transmitted to the engine valve(s) to generate the engine valve lift profile 220*v* for the engine braking valve event 10B. But with the engine brake reset means 150, the engine brake actuation means 100 will be temporarily switched from the extended position to the retracted position during each cycle of the engine braking operation 10, which will truncate the valve lift profile from the large cam lobe to generate the engine valve lift profile 220*h* for the engine braking valve event 10R. Note that the reset means 150 starts when the cam lift gets into the higher portion of the large cam lobe, which is higher than the small cam lobes. Therefore, only the higher portion of the large valve lift profile is truncated. Once the cam lift is back into the lower portion of the large cam lobe, which is below the height of the small cam lobes, the reset means 150 is disengaged and the engine brake actuation means 100 is extended to the operative position again to take up the gap 234 before the small cam lobes start so that the secondary valve lift profile is retained.

Figure 2:
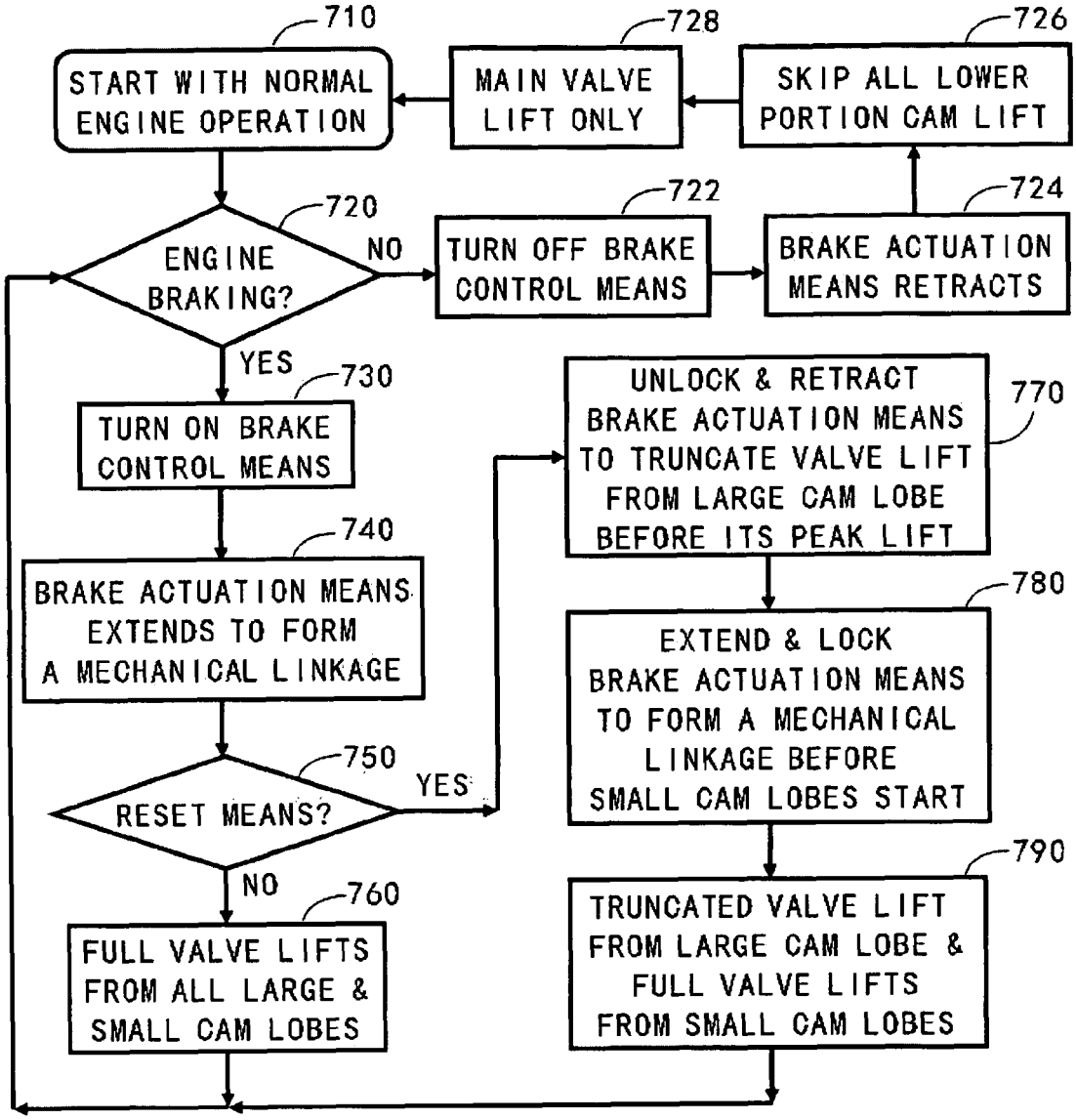
FIG. 2 is a flow chart illustrating the engine braking operation control according to one version of the present invention.

FIG. 2 is a flow chart illustrating the engine braking operation control according to one version of the present invention. It is assumed that the control starts with the normal engine operation block 710. The next control block 720 determines whether engine braking is desired. If it is not, the engine brake control means 50 is turned off, as shown in control block 722, and the engine brake actuation means 100 retracts to the inoperative position 0 (control block 724) to skip all the small cam lobes (control block 726) to produce only the main valve lift profile in control block 728 for the normal engine operation 20.

If engine braking is needed, the engine brake control means 50 will be turned on, as shown in control block 730, and the engine brake actuation means 100 will be extended to form a mechanical linkage, as shown in control block 740, so that all cam motion is picked up by the rocker arm and the integrated engine brake actuation means. The next control block 750 determines if there is an engine brake reset means. If there is no reset means, a full valve lift profile is generated from both the large and small cam lobes, as shown in control block 760. Now the control goes back to the block 720 to start a new cycle of engine braking control.

If the control block 750 shows that there is an engine brake reset means, then the next control block will be 770 in which the reset means 150 retracts the engine brake actuation means 100 so that the valve lift profile from the large cam lobe is truncated. The resetting happens during the higher portion of the large valve lift profile. Once the valve lift gets back to the lower portion of the large valve lift profile, the reset means 150 is disengaged and the actuation means 100 is extended again to form the mechanical linkage, which happens before the small cam lobe starts, as shown in control block 780. Therefore, the reset means 150 works with the engine brake actuation means 100 to produce a truncated large valve lift profile and the full secondary valve lift profile from the small cam lobes, as shown in control block 790. The engine braking control now goes back to block 720 and the control cycle repeats.

Figure 3A:
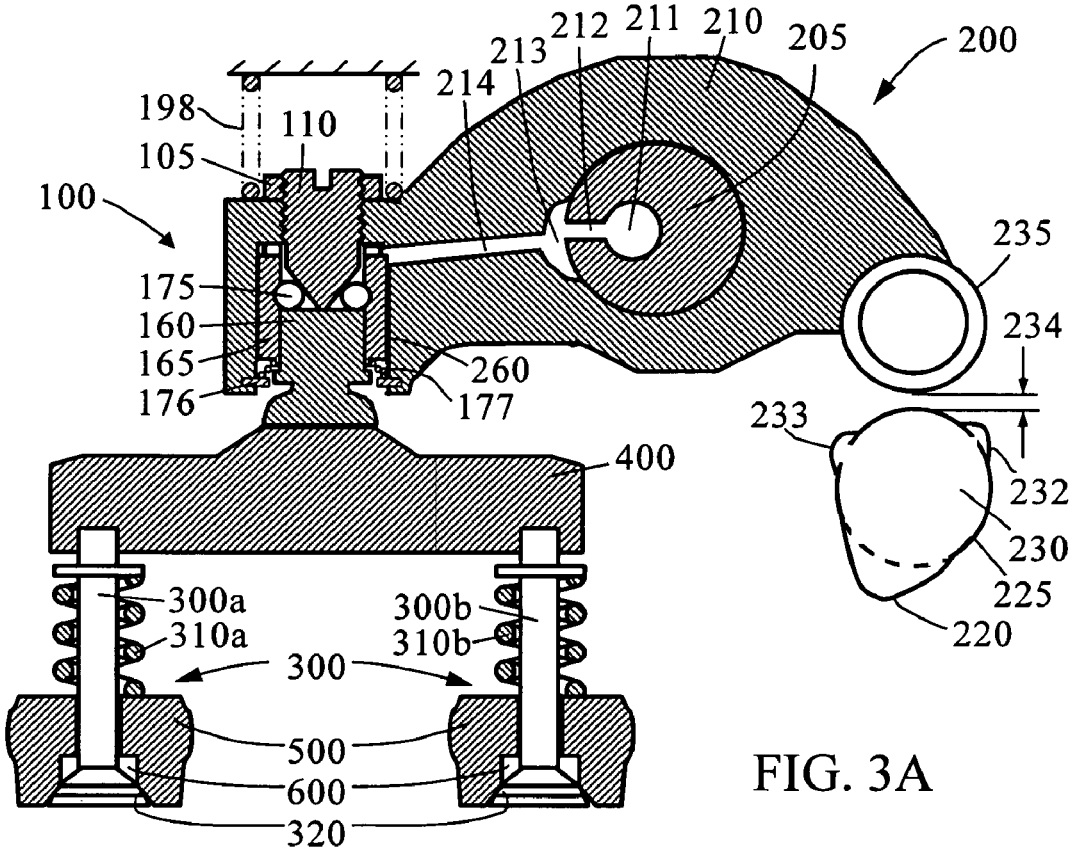
FIGS. 3A and 3B are schematic diagrams of an engine braking apparatus at the "Off" and "On" positions according to a first embodiment of the present invention.
Figure 3B:
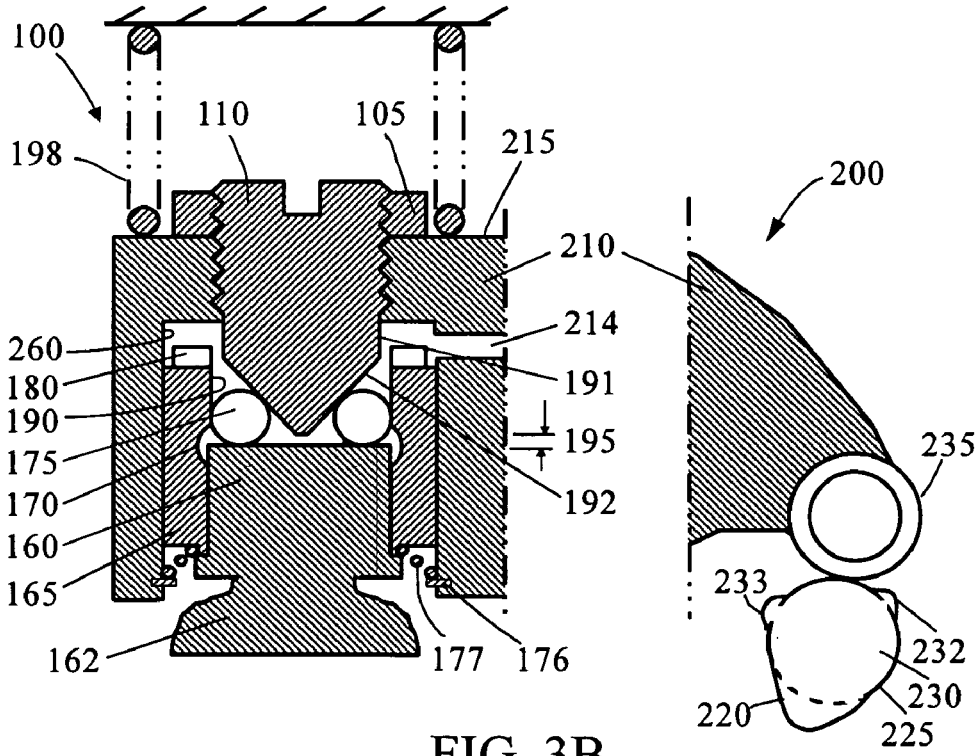

FIGS. 3A and 3B are schematic diagrams of an engine braking apparatus at the "Off" and "On" position according to one embodiment of the present invention. The engine brake actuation means 100 is integrated into a rocker arm 210 of the engine exhaust valve train or the valve lifter 200. The valve train has components that include a cam 230, a cam follower 235, the rocker arm 210, a valve bridge 400, and the exhaust valves 300*a* and 300*b* (or simply 300). The exhaust valves 300 are biased upwards against their seats 320 on the engine cylinder head 500 by engine valve springs 310*a* and 310*b* (or simply 310) to seal gas from flowing between the engine cylinder (not shown) and the exhaust manifolds 600. The rocker arm 210 is pivotally mounted on a rocker shaft 205 for transmitting mechanical input or motion from the cam 230 to the exhaust valves 300 for their cyclical opening and closing.

There may be other valve train components that are not shown here for simplicity, such as an elephant foot that may be attached to the lower portion 162 of the braking piston 160 (FIG. 3B). The cam 230 contains a large lobe 220 above the inner base circle (IBC) 225 mainly for the normal engine operation and two small lobes 232 and 233 for the engine braking operation. The rocker arm 210 is biased against the valve bridge 400 by a spring 198, and a gap 234 is formed between the cam 230 and the cam follower 235 when the engine brake is not turned on (FIG. 3A). The gap 234 is set by a lash adjusting mechanism to such a height that the small cam lobes will be skipped when the engine brake is not needed. The lash adjusting screw 110 is secured on the rocker arm 210 by a lock nut 105 and is also part of the engine brake actuation means 100. Due to the gap 234 among the valve train components, a spring means that may include the spring 198 and its assembly or mounting. The spring 198 is so designed that its preload will be high enough to prevent any of the valve train components from no-following even at the highest engine speed, but at the same time, be low enough to allow the engine brake actuation means 100 to be turned on when needed. One end of the spring 198 is mounted on the engine or a fixed component of the engine, and the other end of the spring 198 is mounted on one of the valve train components, such as the top 215 of the rocker arm 210.

The engine brake actuation means 100 is a ball-locking device with a plurality of balls 175 restrained by three surfaces on three elements, as shown in FIG. 3B. The first surface is the tapered surface 192 on the bottom of the lash adjusting screw 110. The second surface is the flat surface on the top of a braking piston 160 that is slidably disposed in a bore 190 of a ball-locking piston 165. The stroke of the braking piston 160 is 195, which takes up the gap 234 (FIG. 3B). The third surface is either on the annular groove 170 when the ball-locking device is at the retracted or "Off" position as shown in FIG. 3A or on the bore 190 when the ball-locking device is at the extended or "On" position as shown in FIG. 3B.

Figure 4A:
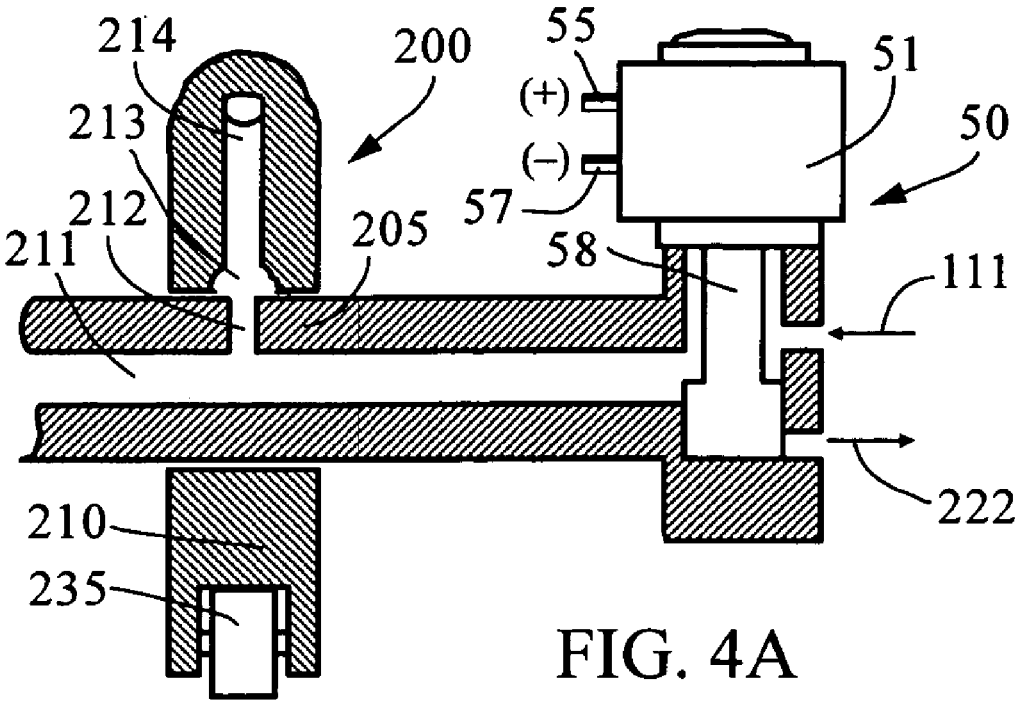
FIGS. 4A and 4B are schematic diagrams of an engine brake control mean at its "On" position and its "Off" or draining position according to one version of the present invention.
Figure 4B:
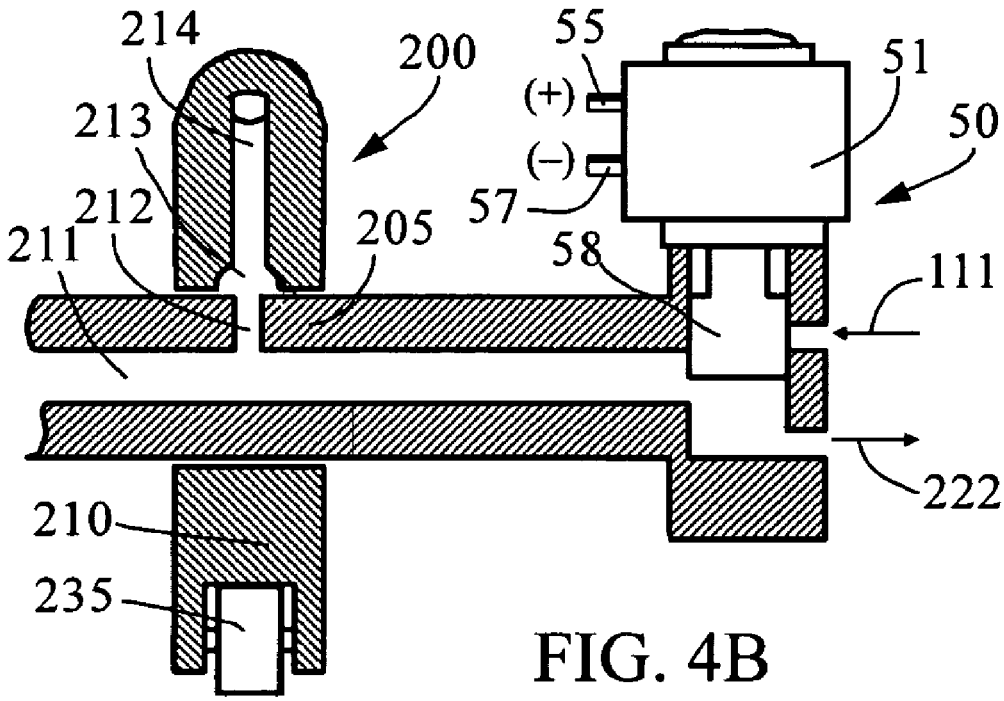

The movement of the engine brake actuation means 100 is controlled by the engine brake control means 50 as shown in FIGS. 4A and 4B, which is shown as an electro-hydro-mechanical system containing a three-way solenoid valve 51. The solenoid valve 51 has a spool 58 and is turned on and off by an electric current through the positive and negative terminals 55 and 57. As the spool 58 slides, it opens or closes a port (an orifice or a drill) 111 or 222 to allow hydraulic fluid, for example, engine lube oil, into or out of an engine braking fluid circuit containing a flow passage 211 and a radial orifice 212 in the rocker shaft 205, an undercut 213 and a flow passage 214 in the rocker arm 210, and a slot or undercut 180 on the ball-locking piston 165 (FIG. 3B). Note that the engine brake control means 50 could be remotely located and used for controlling engine brakes over multiple engine cylinders and the braking fluid circuit may reach other components of the engine and of the actuation means 100.

When engine brake is needed, the engine brake control means 50 is turned on (FIG. 4A) and the engine oil is transmitted to the engine brake actuation means 100 through the braking fluid circuit. FIG. 3B shows that the engine oil from flow passage 214 can get to the bottom of the lash adjusting screw 110 because its stem 191 is smaller than the bore 190 of the ball-locking piston 165 in which the braking piston 160 slides. Oil pressure overcomes the force of spring 198 and pushes up the rocker arm 210 for a clockwise rotation to take up the gap 234 between the cam 230 and the cam follower 235 (FIG. 3B). As the lash adjusting screw 110 moves up along with the rocker arm 210, the balls 175 move inwards along the tapered surface 192 and out of the annular groove 170 in the ball-locking piston 165. Now the ball-locking piston 165 can move down in a bore 260 in the rocker arm 210, since the oil pressure overcomes the force of spring 177 on spring seat 176. Once the ball-locking piston 165 is stopped on the shoulder of the brake piston 160, the ball-locking device is locked at its extended position or the operative position as shown in FIG. 3B, which takes up the gap 234 and forms a mechanical linkage. Without the gap 234, all the motion from the cam 230 is transmitted to the exhaust valves 300 to produce an enlarged main valve lift profile and a secondary lift profile for the engine braking operation.

When engine braking is not needed, the engine brake control means 50 is turned off (FIG. 4B) and there will be little or no oil pressure acting on the ball-locking piston 165, which will be pushed upwards by the spring 177 towards the top of the bore 260. Once the annular groove 170 in the ball-locking piston 165 is aligned with the balls 175, they will be pushed outwards and into the annular groove 170 by the downward motion of the tapered surface 192 on the lash adjusting screw 110 under the force of spring 198. Now the ball-locking device is at the retracted position or the inoperative position and the gap 234 between the cam 230 and the cam follower 235 is formed to skip part of the cam motion, i.e., the lower portion of cam 230 shown in FIG. 3A to produce the main valve lift profile for the normal engine operation.

It can be seen that the present invention provides engine brake actuation means that transmits force, or the engine braking load, through mechanical linkage means that does not have high compliance and overloading problems associated with traditional hydraulic means used by the prior art engine braking systems. Therefore, there will be much less valve lift loss due to lower compliance. Both the stroke and the diameter of the braking piston 160 can be designed much smaller than the prior art with hydraulic means, which will greatly reduce the engine braking response time, the moment of inertia and the effect of excessive high valve lift on engine operation. Also, the gap 234 among the valve train components will be smaller, which leads to less potential of no-follow of the valve train components.

Figure 5A:
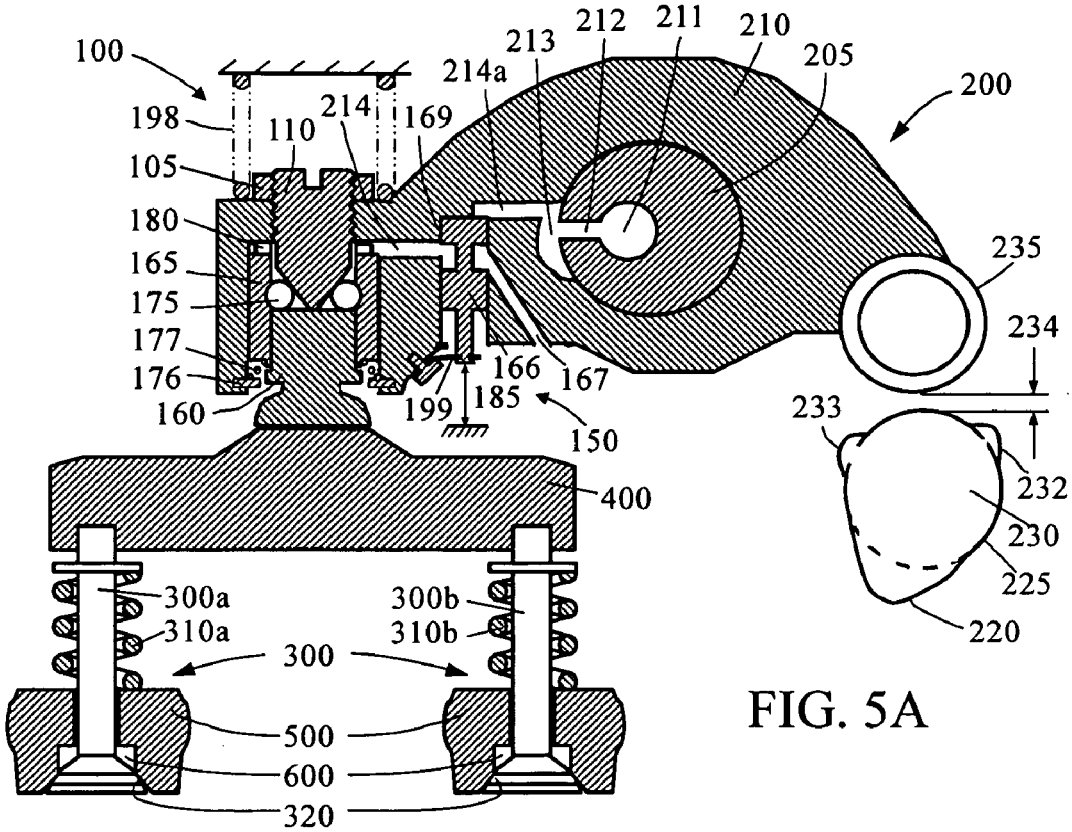
FIGS. 5A and 5B are schematic diagrams of an engine braking apparatus at the "Off" and "On" positions according to a second embodiment of the present invention.
Figure 5B:
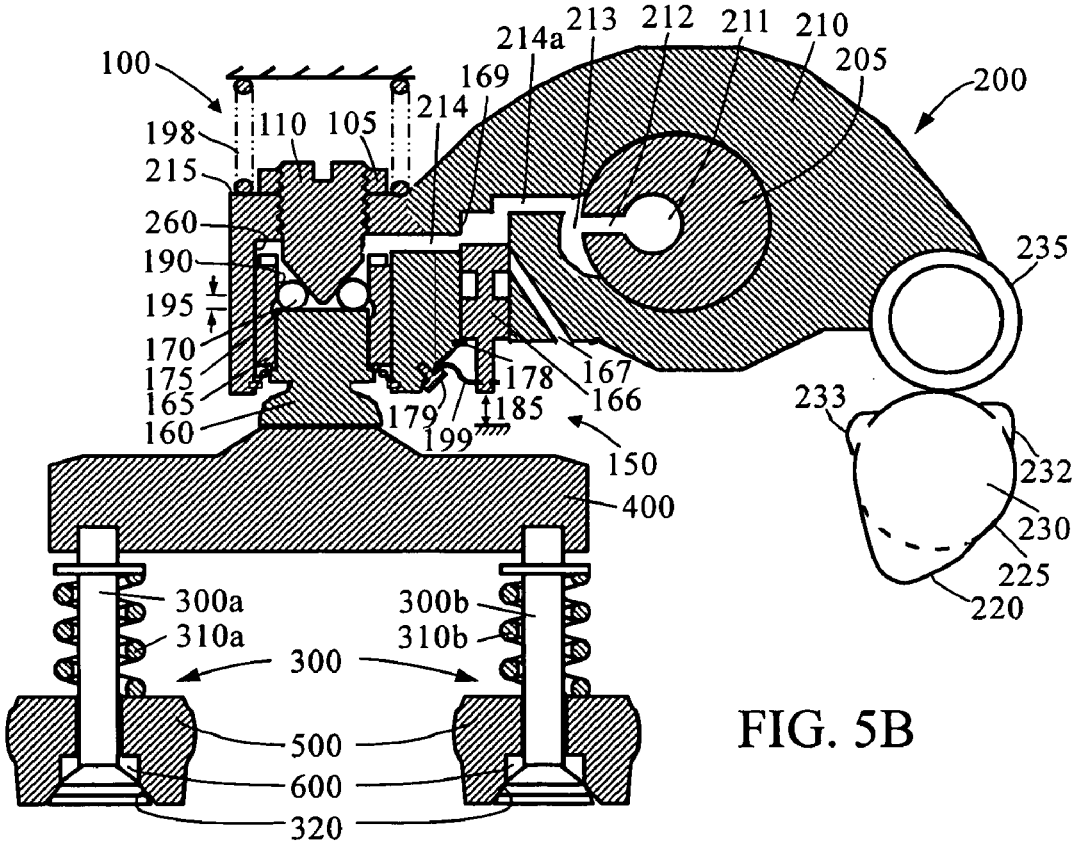

FIGS. 5A and 5B show a different version of the embodiment in FIGS. 3A and 3B with an added engine brake reset means 150 to interact with the engine brake actuation means 100. The reset means 150 comprises a reset piston 166 that is slidably disposed in a reset bore 169 in the rocker arm 210. During the normal engine operation, the reset piston 166 is biased up to the top of the reset bore 169 (FIG. 5A) by a spring 199 that is secured to the rocker arm 210 by a screw 179 (FIG. 5B). The gap 185 between the reset piston and the engine block is so designed that the reset piston 166 will not touch the engine block during the whole cam rotation when engine brake is not actuated (FIG. 5A).

With the reset means 150, the electro-hydro-mechanical system of the engine brake control means 50, as shown in FIGS. 4A and 4B, does not need to have a three-way solenoid valve 51 because the reset means 150 is also a flow draining means and will drain the engine oil in the engine brake actuation means 100 to turn off the engine brake when needed. Therefore there is no need for the drain port 222, and the three-way solenoid valve 51 can be replaced by a two-way solenoid valve to open and close the oil supply port 111.

During the engine braking operation, oil is transmitted to the higher chamber over the top of the reset piston 166 through a flow path 214*a* as shown in FIG. 5B. Oil pressure overcomes the force of spring 199 and pushes the reset piston 166 down to a stop 178, which allows oil flow to the ball-locking device through the flow path 214 but blocks the drain passage 167. The gap 185 between the reset piston 166 and the engine block is reduced but still large enough that the rocker rotation by the small cam lobes 232 and 233 will not reset the engine brake actuation means 100. Only during the anticlockwise rocker arm rotation by the higher portion of the large cam lobe 220, the reset piston 166 will touch the engine block and stop moving down while the reset bore 169 continues the downward motion with the rocker arm 210. The reset piston 166 will block the flow passage 214*a* and connect the flow passage 214 to the drain passage 167 to release oil pressure from the engine brake actuation means 100. Without oil pressure, the ball-locking piston 165 will be pushed upwards by the spring 177 towards the top of the bore 260 in the rocker arm 210 and unlock the ball-locking device to the retracted position as shown in FIG. 5A. A portion of the cam lift equal to the gap 234 will be skipped or lost due to the resetting, and the valve train will get shorter so that the enlarged main valve lift profile is truncated back to the main valve lift profile. When the cam rotation passes the peak of the large cam lobe 220, the rocker arm 210 will rotate clockwise and move away from the engine block so that the reset piston 166 will slide down in the reset bore 169 under the oil pressure. When the cam lift gets into the bottom part of the enlarged cam lobe 220 or below the peak lift of the small lobes 232 and 233, the drain passage 167 is blocked and the reset mean 150 is disengaged. The oil supply to the ball-locking device is resumed from the passage 214*a* to the passage 214. Under oil pressure, the ball-locking device is extended and locked up again to the operative position, and the gap 234 between the cam 230 and cam follower 235 is taken up, which happens on IBC 225 and before the small cam lobe 232. Therefore, with the reset means 150, the engine valve lift for the engine braking operation will have all the valve lifts from the small cam lobes 232 and 233 but a truncated valve lift from the large cam lobe 220.

FIG. 6 illustrates the engine exhaust valve lift profiles according to one version of the present invention. The main valve lift profile 220*m* is for the normal engine operation and the enlarged main valve lift profile 220*v* plus the secondary valve lift profile with valve lifts 232*v* and 233*v* is for the engine braking operation when there is no engine brake resetting. There is also a hybrid valve lift profile for the engine braking operation, which is obtained with the engine brake reset means 150.

During the normal engine operation, the valve lift 220*a* from part of the cam, i.e., the lower portion of cam 230, including 232*v* and 233*v* from the small cam lobes 232 and 233, is skipped due to the gap 234 among the valve train components. Only the higher portion 220*b* is transmitted to the engine valves 300 to generate the main valve lift profile 220*m* which starts at point 225*a* and ends at point 225*b* with a peak lift of 220*b*. The lower portion 220*a* and the higher portion 220*b* are divided by the transition line passing through the transition point 220*t*. The height 232*p* of the lower portion 220*a* is close to that of the valve lifts 232*v* and 233*v*, while the higher portion 220*b* is about the same as the main valve lift profile 220*m*.

During the engine braking operation, the engine brake actuation means 100 is extended and the gap 234 among the valve train components is taken up. All the motion from the cam 230 can be transmitted to the exhaust valves 300. However, the valve lift profile depends on the existence of the reset means 150. If there is no reset means as shown in FIGS. 3A and 3B, then the valve lift profile will start at point 225*d* as shown in FIG. 6, go over the braking gas recirculation (BGR) bump 232*v*, be followed by the compression release braking (CRB) bump 233*v*, then pass the transition point 220*t* between the lower portion 220*a* and the higher portion 220*b*, move up to the reset point 220*r* (but no resetting) and over the peak 220*e* of the enlarged main valve lift profile 220*v*, finally close at point 225*c* with zero valve lift.

If there is an engine brake reset means 150 as shown in FIGS. 5A and 5B, then the valve lift profile during the engine braking operation will be the same as the no-reset braking valve lift profile until it hits the reset point 220*r* (FIG. 6). Then the valve lift will drop back from the reset point 220*r* on the enlarged main valve lift profile 220*v* to the point 220*s* on the main valve lift profile 220*m*, and finally close at point 225*b*, much earlier than the point 225*c*. Theoretically, the reset point 220*r* can be anywhere between the transition point 220*t* and the peak enlarged valve lift 220*e*. But making the reset point 220*r* closer to the peak enlarged valve lift 220*e* reduces the oil consumption and the reset piston travel.

The engine brake reset means 150 according to the present invention eliminates the drawbacks of those disclosed by the prior art, for example, the '730 patent. First, the timing and magnitude (or height) of the resetting is not critical. The resetting does not happen during the engine braking lift profile 233*v*, but during the higher portion 220*b* of the enlarged main valve lift profile 220*v*. Second, there is no high oil pressure or large load acting on the reset valve or piston because the engine braking load from the current engine brake system is not supported by a hydraulic means but a mechanical linkage means. Resetting is basically decoupling or disengaging the mechanical linkage. Therefore, the reset means disclosed here is more reliable, more tolerant to variation and easier to design and manufacture.

FIG. 7 and its cross-section drawing FIG. 7A-A show a different version of the embodiment in FIGS. 5A and 5B with an added oil retaining means 350 to the reset means 150. The oil retaining means 350 comprises an oil retaining piston 155 that is biased downwards by a spring 156 to seal a drain orifice 167*a*. The spring 156 is seated on a spring seat 158 and the piston 155 is slidably disposed in a bore 154 in the rocker arm 210. The oil retaining means 350 is designed to keep engine oil in the engine brake fluid circuit mainly for lubrication purpose.

Two levels of oil supply pressure could be provided to the engine braking fluid circuit. During the engine braking operation, the engine lube oil with full supply pressure (for example, 30 psi gage) flows into the braking circuit to actuate the engine braking means 100, while during the normal engine operation, oil with a lower level pressure (for example, 5 psi gage) is not able to actuate the engine brake actuation means 100, the reset piston 166, nor the oil retaining piston 155. However, the oil can still flow through the orifice 152 in the reset piston 166 (FIG. 7) and into the engine brake actuation means 100 for system lubrication. Keeping the engine oil in the engine brake fluid circuit also makes the engine braking operation turn on faster. In another word, it reduces engine braking control response time.

During the engine braking operation, oil released from the actuation means 100 by the reset means 150 has enough pressure to push the oil retaining piston 155 upwards against the spring 156 and open the drain hole 167*a* so that oil can flow from the actuation means 100 to the ambient through the flow passages 214, 167 and 167*a* to complete the engine brake resetting process.

Figure 8A:
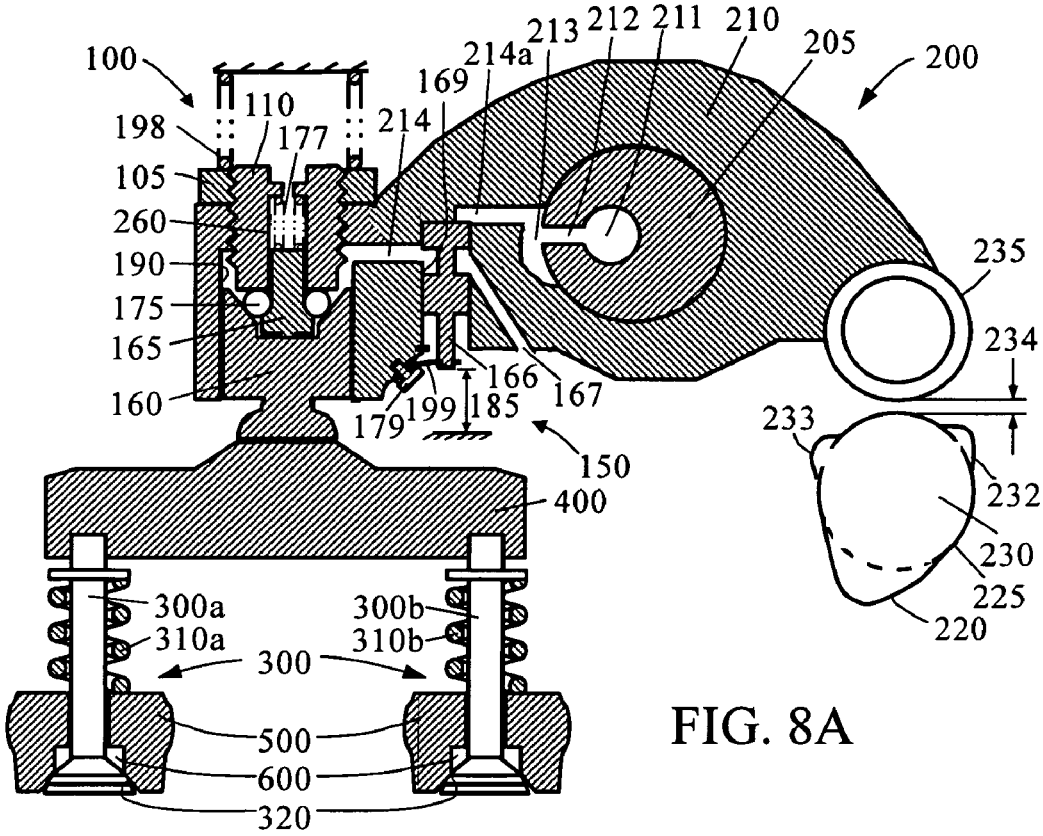
FIGS. 8A and 8B are schematic diagrams of an engine braking apparatus at the "Off" and "On" positions according to a third embodiment of the present invention.
Figure 8B:
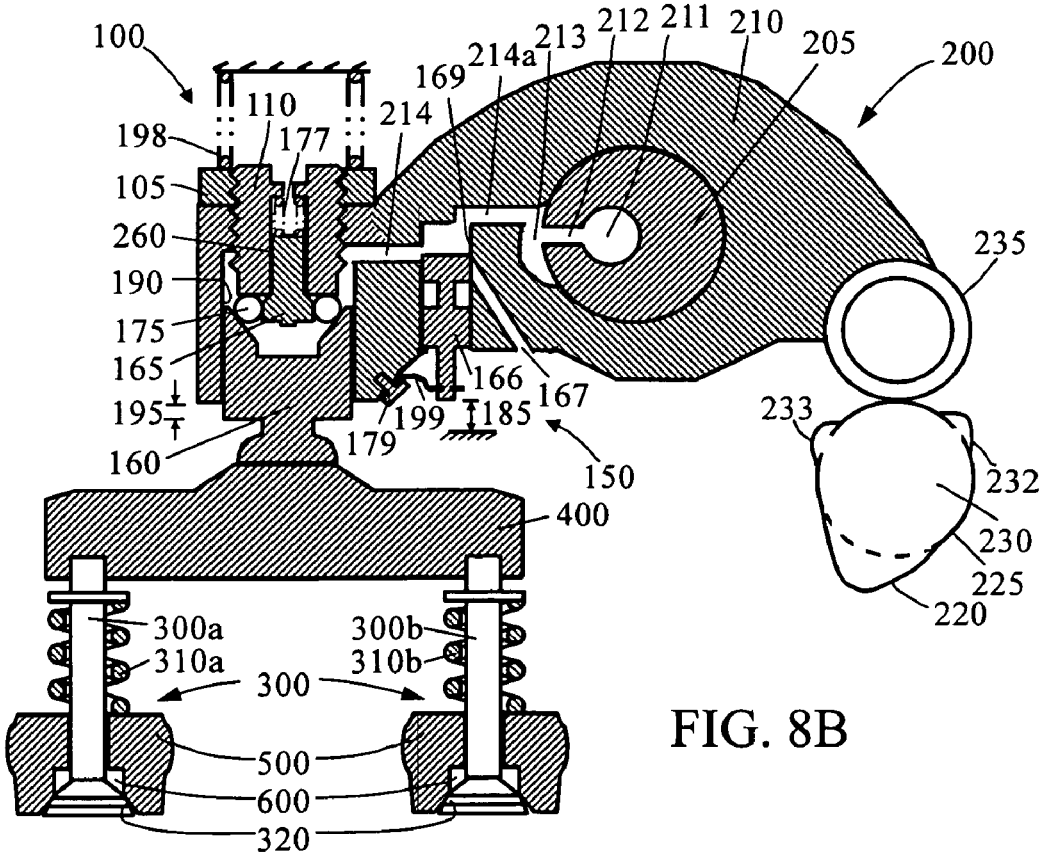

FIGS. 8A and 8B show another embodiment of the present invention with a different ball-locking device. Again, the balls 175 are restrained by three surfaces on three different elements of the engine brake actuation means 100. The first surface is a tapered surface on the braking piston 160. The second is the bottom flat surface on the adjusting screw 110, and the third is either the small diameter surface of the ball-locking piston 165 when the ball-locking device is at the retracted position (FIG. 8A) or the larger diameter surface when the ball-locking device is at the extended position (FIG. 8B). As with the previous embodiments, the lash adjusting mechanism is incorporated into the engine brake actuation means 100. A washer can be added between the screw 110 and the balls 175 to reduce the size of the screw 110.

When engine braking is needed, the engine brake control means 50 is turned on (FIG. 4A) to supply engine oil to the engine brake actuation means 100 through the engine brake fluid circuit. Oil pressure overcomes the force of spring 198 and pushes up the rocker arm 210 for a clockwise rotation to take up the gap 234 between the cam 230 and the cam follower 235 as shown in FIG. 8A. As the lash adjusting screw 110 moves up along with the rocker arm 210, the balls 175 move up and outwards along the tapered surface on the braking piston 160. The ball-locking piston 165 also moves up with the lash adjusting screw 110. When the balls 175 are out of the way, the ball-locking piston 165 moves up further into the bore in the lash adjusting screw 110 with the oil pressure overcoming the force of spring 177. Once the ball-locking piston 165 is stopped on the lash adjusting screw 110, the ball-locking device is locked to the extended or operative position to form a mechanical linkage, as shown in FIG. 8B. The motion from the whole cam 230 picked up by the rocker arm 210. But due to the engine brake reset means 150, a portion of the cam lift equal to the gap 234 will be truncated from the higher portion of the enlarged cam lobe 220 so that the engine valve lift for the engine braking operation will have all the valve lifts from the small cam lobes 232 and 233 but a truncated valve lift from the enlarged cam lobe 220. If there is no engine brake reset means, then the full cam motion from all the cam lobes, large and small, is transmitted to the exhaust valves 300 to produce an enlarged main valve lift profile and a secondary lift profile for the engine braking operation.

When engine braking is not needed, the engine brake control means 50 is turned off (FIG. 4B) and there will be little or no oil pressure acting on the ball-locking piston 165, which will be pushed down towards the braking piston 160 by the spring 177. Note that there is an orifice at the top of the lash adjusting screw 110 to eliminate hydraulic lock. Once the ball-locking piston 165 is down against the braking piston 160, the balls 175 will move down and inwards along the tapered surface on the braking piston 160, and the lash adjusting screw 110 can move down with the rocker arm 210 under the force of spring 198. Now the ball-locking device is at the retracted or inoperative position and the gap 234 between the cam 230 and the cam follower 235 is formed to skip the lower portion of the cam 230 including the small cam lobes 232 and 233 to produce the main valve lift profile for the normal engine operation.

Figure 9A:
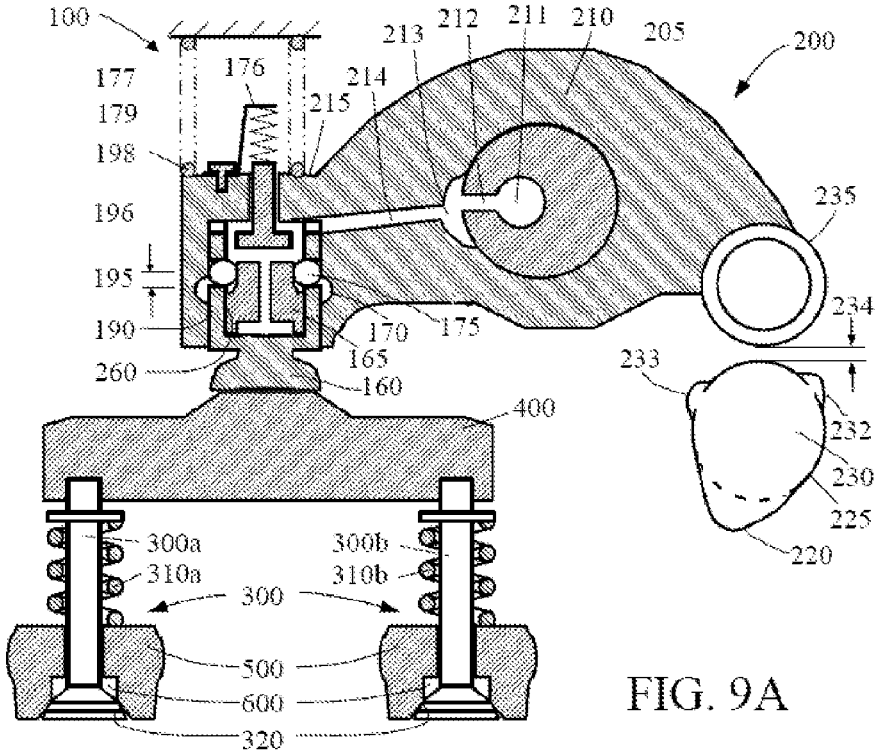
FIGS. 9A and 9B are schematic diagrams of an engine braking apparatus at the "Off" and "On" positions according to a fourth embodiment of the present invention.
Figure 9B:
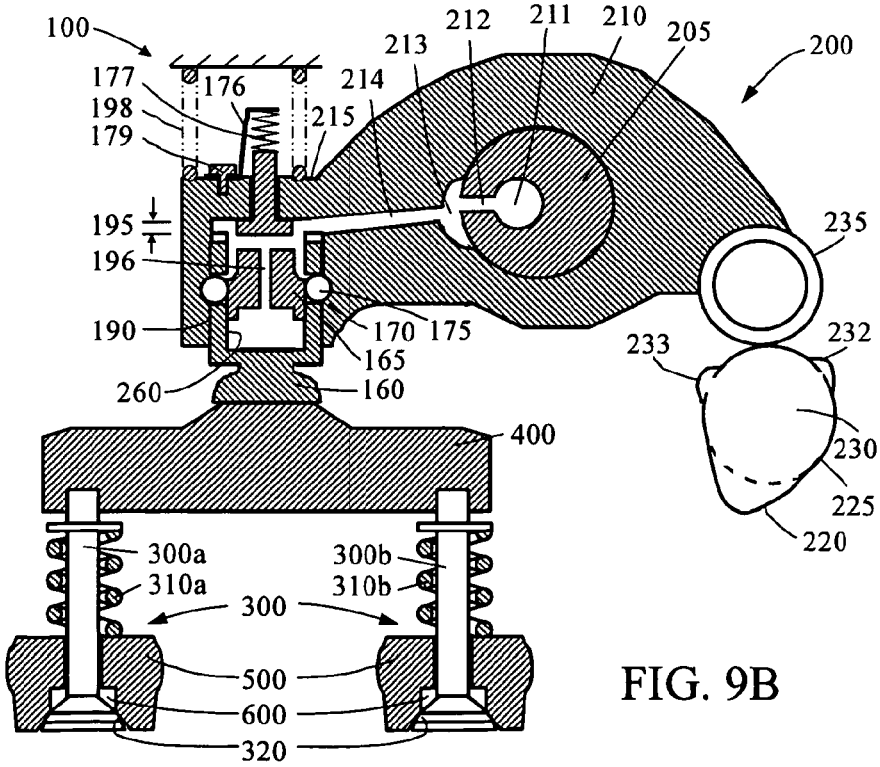

FIGS. 9A and 9B show an embodiment of the engine brake actuation means 100 with another ball-locking device in the rocker arm 210 and over the valve bridge 400. The balls 175 are always restrained by holes in the braking piston 160 that is normally retracted in the bore 190 under the load of spring 198. The ball-locking piston 165 is biased to the bottom of 260 in the braking piston 160 by the spring 177 that has a seat 176 mounted on the rocker arm 210 with a screw 179.

When engine braking is needed, the engine brake control means 50 is turned on (FIG. 4A) to supply engine oil to the engine brake actuation means 100 through the engine brake fluid circuit. Oil pressure overcomes the force of spring 198 and pushes up the rocker arm 210 for a clockwise rotation to take up the gap 234 between the cam 230 and the cam follower 235, as shown in FIG. 9A. The annular groove 170 in the rocker arm 210 will align with the balls 175 that will move outwards and into the groove 170 under the urge of the upward motion of the ball-locking piston 165. Note that the braking piston 160 is pushed against the valve bridge 400 and does not move when the cam 230 is at the IBC 225. Once the balls 175 are in the groove 170, the ball-locking piston 165 will slide up in the bore 260 in the braking piston 160 because oil gets to the bottom from the flow passage 196 and the oil pressure overcomes the force by spring 177. Once the ball-locking piston 165 is at the top of the bore 190 in the rocker arm 210, the balls 175 are locked into the groove 170 by the larger outer diameter of the ball-locking piston as shown in FIG. 9B. Now the ball-locking device is at the extended position with a stroke or travel 195 that will take up the gap 234 and form a mechanical linkage. The motion from the whole cam 230 is transmitted to the exhaust valves 300 to produce an enlarged main valve lift profile and a secondary lift profile for the engine braking operation. A reset means can be easily added to modify the enlarged main valve lift.

When engine braking is not needed, the engine brake control means 50 is turned off (FIG. 4B) and there will be little or no oil pressure acting on the ball-locking piston 165, which will be pushed down to the bottom of the bore 260 in the braking piston 160 by the spring 177. Once the ball-locking piston 165 is down against the braking piston 160, the balls 175 can move inwards and out of the annular groove 170, and the rocker arm 210 will move down under the force of spring 198. Now the ball-locking device is at the retracted position and the gap 234 between the cam 230 and the cam follower 235 is formed to skip part of the cam motion, i.e., from the lower portion of the cam 230 including the small cam lobes 232 and 233 shown in FIG. 9A to produce the main valve lift profile for the normal engine operation.

Figure 10A:
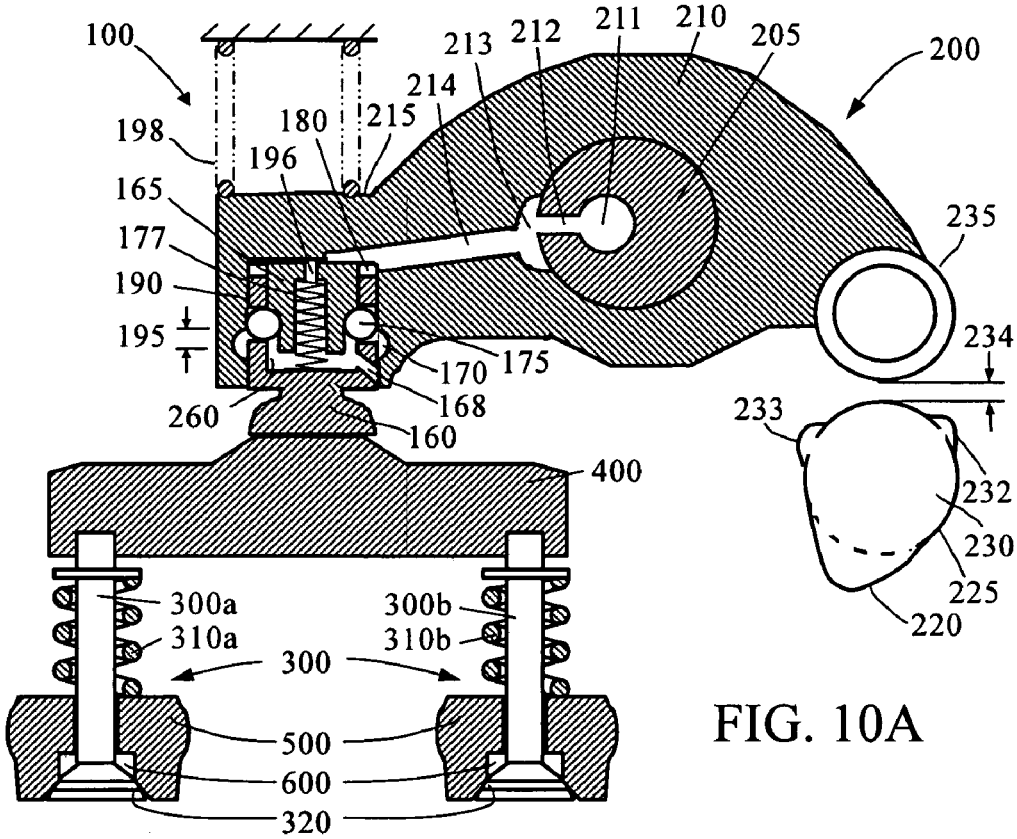
FIGS. 10A and 10B are schematic diagrams of an engine braking apparatus at the "Off" and "On" positions according to a fifth embodiment of the present invention.
Figure 10B:
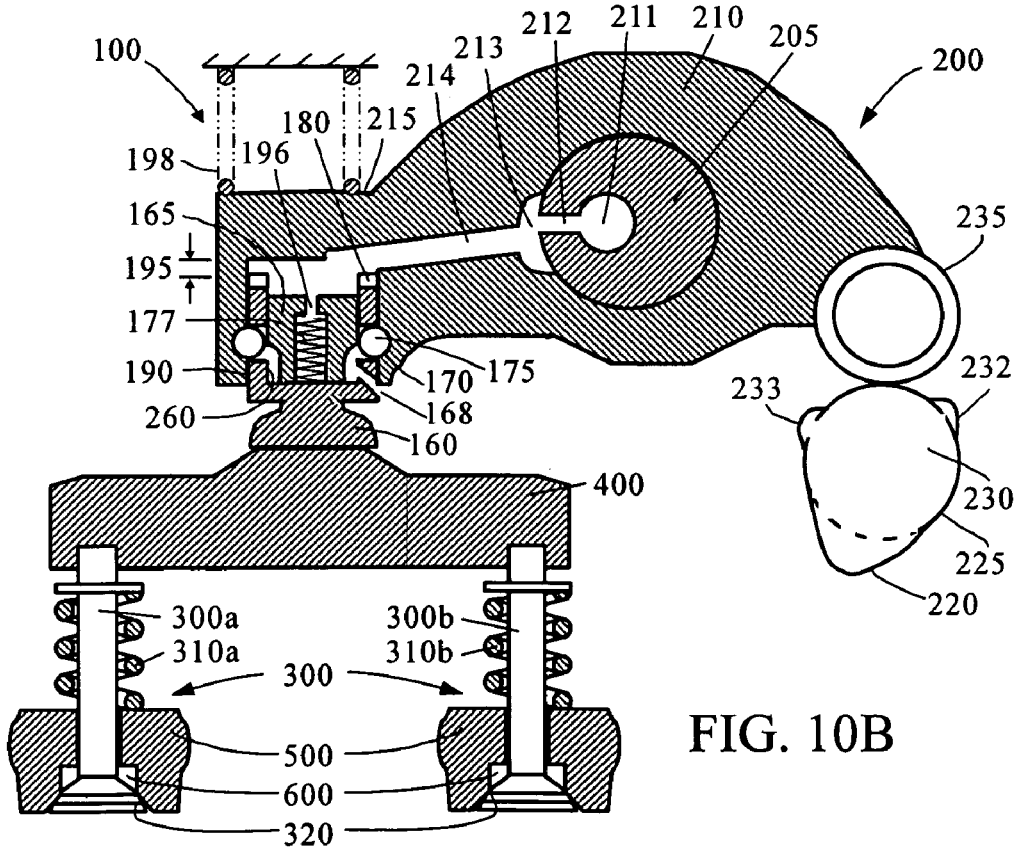

FIGS. 10A and 10B show a similar embodiment to that shown in FIGS. 9A and 9B except that the ball-locking piston 165 and spring 177 are fully contained in the bore 190 in the rocker arm 210. The flow orifice 168 is added to eliminate the hydraulic lock, which enables the motion of the ball-locking piston 165 in the bore 260. The flow passage or orifice 196 is optional and can be eliminated. However, without the orifice 196, a three-way solenoid valve is needed to turn off the engine brake.

When engine braking is needed, the engine brake control means 50 is turned on (FIG. 4A) to supply engine oil to the engine brake actuation means 100 through the engine brake fluid circuit. Oil pressure overcomes the force of spring 198 and pushes up the rocker arm 210 for a clockwise rotation to take up the gap 234 between the cam 230 and the cam follower 235, as shown in FIG. 10A. As the rocker arm 210 moves up, the flow orifice 168 will be uncovered, and the annular groove 170 aligned with the balls 175 that will move outwards and into the groove 170 under the urge of the downward motion of the ball-locking piston 165. Once the balls 175 are in the groove 170, the ball-locking piston 165 will move down because the oil pressure overcomes the force of spring 177. The balls 175 are locked into the groove 170 by the larger outer diameter surface of the ball-locking piston 165. The oil flow through the orifice 168 is blocked when the ball-locking piston 165 sits on the braking piston 160 to reduce oil consumption. As shown in FIG. 10B, the ball-locking device is now at the extended position with a stroke or travel 195 that will take up the gap 234 to form a mechanical linkage. Without the gap 234, all cam motion is transmitted to the exhaust valves 300 to produce an enlarged main valve lift profile and a secondary lift profile for the engine braking operation.

When engine braking is not needed, the engine brake control means 50 is turned off (FIG. 4B) and there will be little or no oil pressure acting on the ball-locking piston 165, which will slide up in the braking piston 160 under the force of spring 177. The balls 175 will move inwards and out of the annular groove 170, and the rocker arm 210 will move down under the force of spring 198. Now the ball-locking device is at the retracted position and the gap 234 between the cam 230 and the cam follower 235 is formed to skip the lower portion of the cam 230 including the small cam lobes 232 and 233, as shown in FIG. 10A.

Figure 11A:
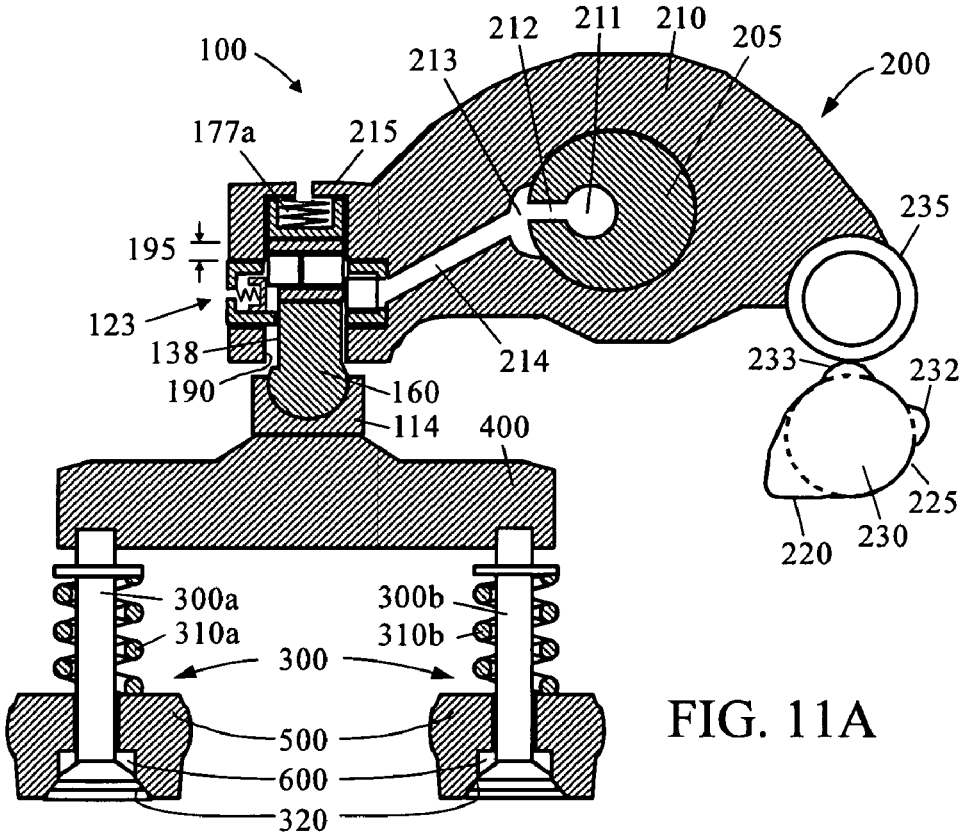
FIGS. 11A and 11B are schematic diagrams of an engine braking apparatus at the "Off" and "On" positions according to a sixth embodiment of the present invention.
Figure 11B:
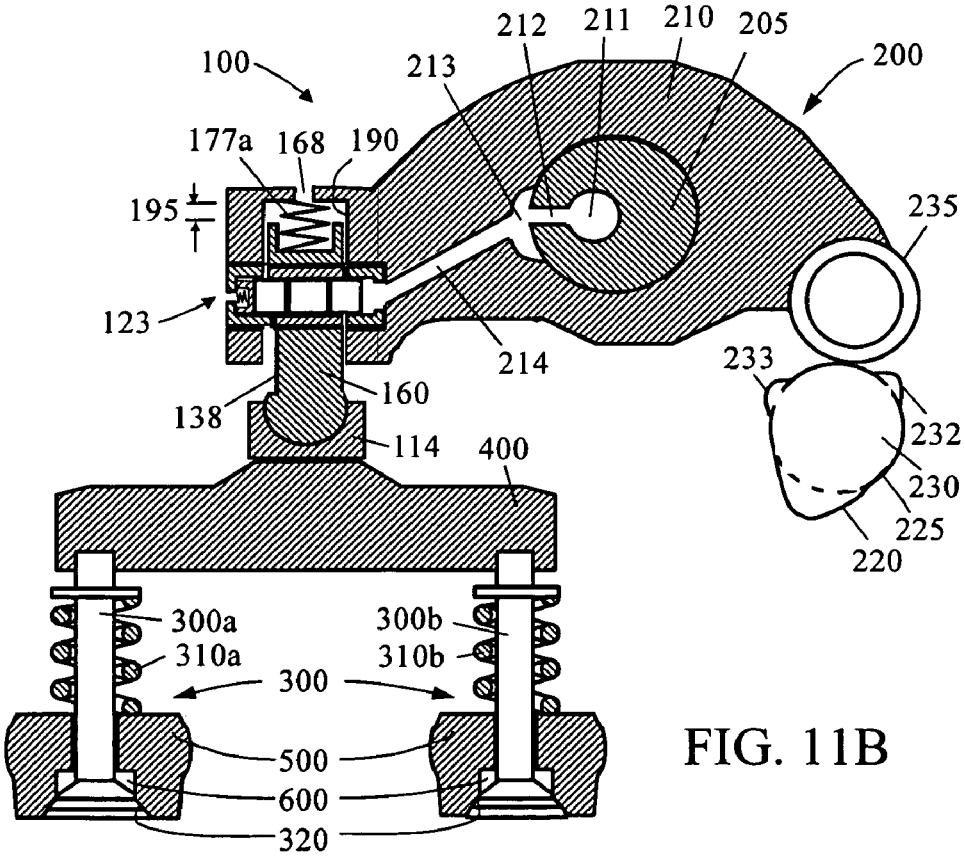
Figure 11C:
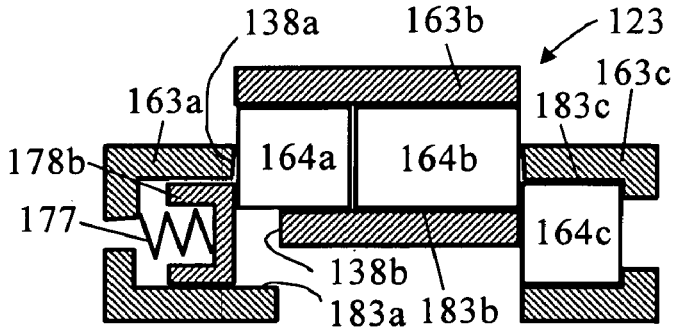
FIGS. 11C and 11D show details of the piston coupling device used in the embodiment shown in FIGS. 11A and 11B at the "Off" and "On" positions.
Figure 11D:
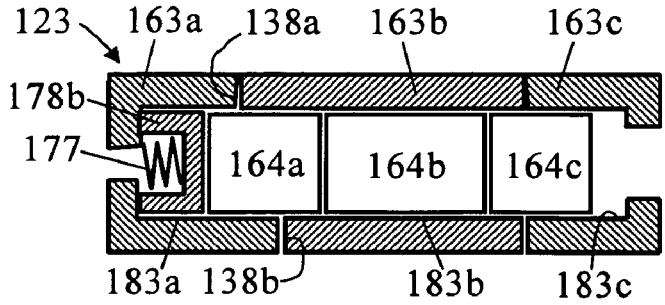

FIGS. 11A and 11B show an embodiment of the engine brake actuation means 100 with a piston-coupling device 123 in the rocker arm 210 whose details are shown in FIGS. 11C and 11D. There are three pistons 164*a*, 164*b* and 164*c* slidably disposed in the bores 183*a*, 183*b* and 183*c* of three sleeves 163*a*, 163*b* and 163*c*. Sleeve 163*b* is fixed in the braking piston 160 while sleeves 163*a* and 163*c* are fixed in the rocker arm 210. Sleeves 163*a* and 163*b* have a step or a half-cut 138*a* and 138*b* (FIG. 11C) so that they can be easily aligned (FIGS. 11B and 11D). Also, the step 138*a* on sleeve 163*a* protrudes out of the bore 190 and fits into an axial groove or cut 138 on the braking piston 160 as a guide.

During the normal engine operation, the engine brake control means 50 is turned off (FIG. 4B) and there will be little or no oil pressure to actuate the actuation means 100. The three pistons 164*a*, 164*b* and 164*c* are biased to the right against the sleeve 163*c* by the spring seat 178*b* that is slidably disposed in the sleeve 163*a* and loaded by the spring 177. The pistons 164*a* and 164*b* are now contained in the sleeve 163*b* and can slide upward in the bore 190 with the braking piston 160 to the inoperative position. The stroke of the braking piston is 195, which is equal to the valve lift by the braking cam lobes 232 and 233. Part of the motion, i.e., from the lower portion of the cam 230 will not be transmitted to the valves 300 but absorbed by the relative motion of the braking piston 160 in the bore 190 in the rocker arm 210 (FIG. 11A). Only the remaining part of the motion, i.e., from the higher portion of the enlarged cam lobe 220 is transmitted to the exhaust valves 300 for the normal engine operation.

When engine braking is needed, the engine brake control means 50 is turned on (FIG. 4A) to supply engine oil to the engine brake actuation means 100. The spring 177*a* biases the braking piston 160 down toward the valve bridge 400, which is stopped when the step 138*a* of sleeve 163*a* contacts the step 138*b* of the sleeve 163*b*. Now the sleeves are aligned to each other, as shown in FIGS. 11B and 11D. Oil pressure overcomes the force of spring 177 and pushes the pistons 164*a*, 164*b* and 164*c* to the left and stopped by the spring seat 178*b* on the sleeve 163*a*. Now the braking piston 160 cannot move up in the bore 190 in the rocker arm 210 but locked to the operative position. A mechanical linkage is formed by the coupled pistons and sleeves as shown in FIG. 11D. All the cam motion from the small and large cam lobes is transmitted to the exhaust valves 300 for the engine braking operation.

Figure 12A:
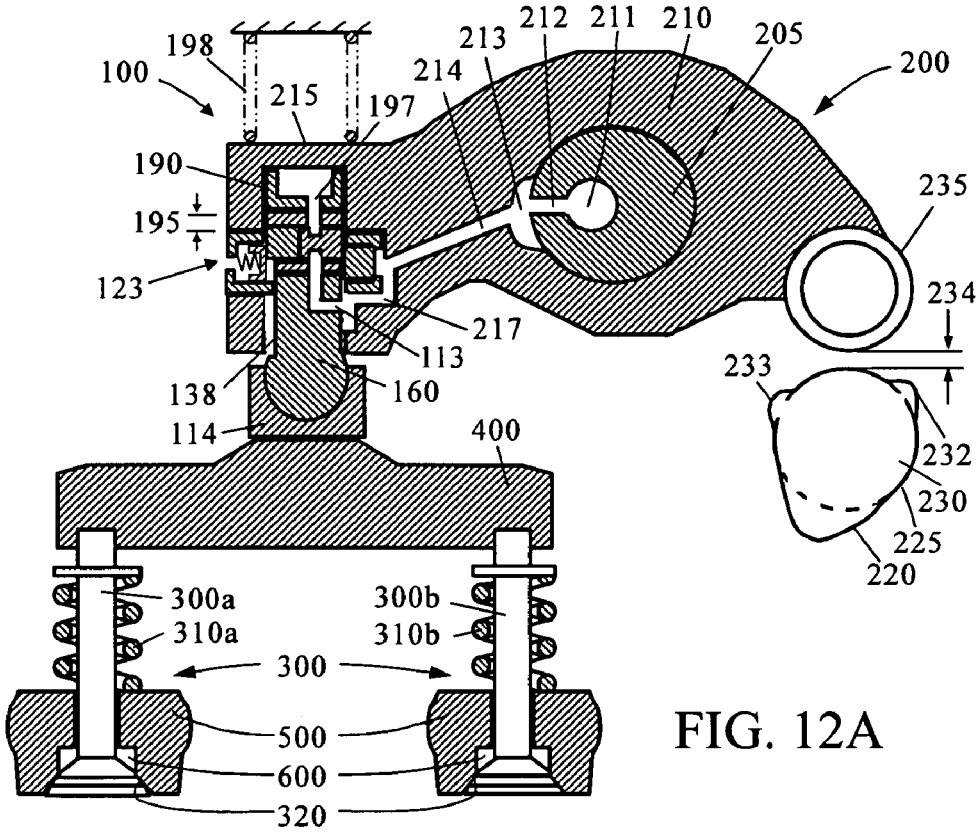
FIGS. 12A and 12B are schematic diagrams of an engine braking apparatus at the "Off" and "On" positions according to a seventh embodiment of the present invention.
Figure 12B:
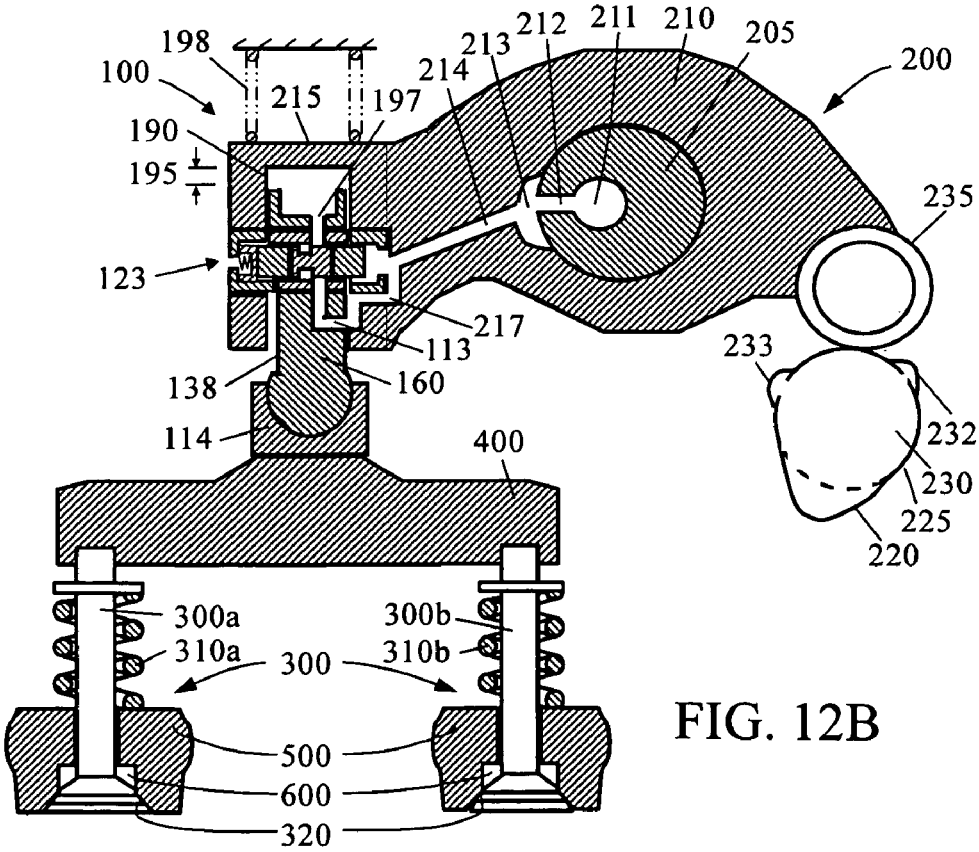

FIGS. 12A and 12B are schematic diagrams of an engine braking apparatus at the "Off" and "On" positions according to a variation from the embodiment shown in FIGS. 11A and 11B. The rocker arm 210 is biased down against the braking piston 160 to the valve bridge 400 by a spring 198 mounted on the rocker arm top 215 so that a gap 234 is formed between the cam 230 and the cam follower 235 when the engine brake is at the "Off" or inoperative position as shown in FIG. 12A. The motion of the lower portion of the cam 230 including the small braking cam lobes 232 and 233 will be skipped. Only the higher portion of the enlarged cam lobe 220 is transmitted to the exhaust valves 300 for the normal engine operation.

Figure 12C:
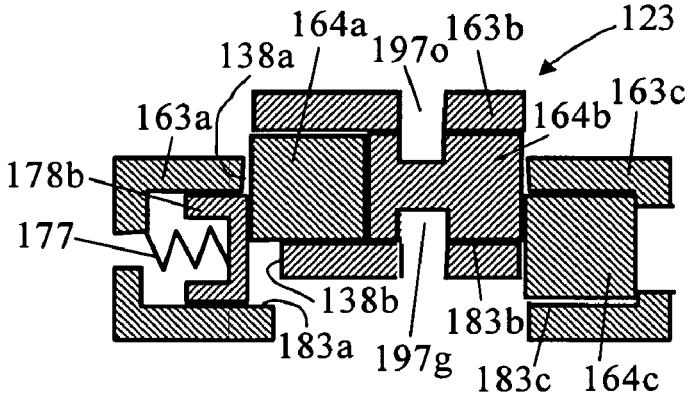
FIGS. 12C and 12D show details of the piston coupling device used in the embodiment shown in FIGS. 12A and 12B at the "Off" and "On" positions.
Figure 12D:
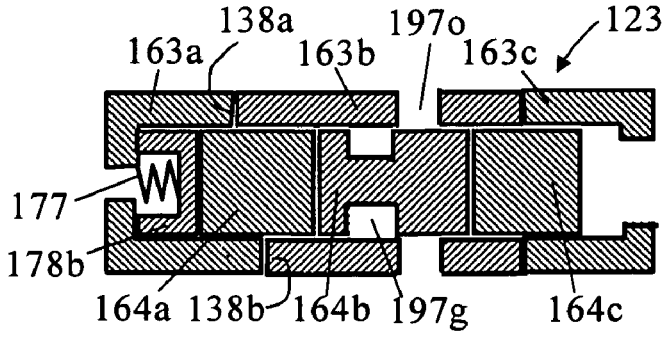

When engine braking is needed, the engine brake control means 50 is turned on (FIG. 4A) to supply engine oil to the top of the braking piston 160 through the braking fluid circuit that further includes the flow passage 217 around the sleeve 163*c*, the flow passage 113 in the braking piston 160, the orifices 197*o* in the sleeve 163*b* (FIG. 12C), the annular groove 197*g* on the piston 164*b*, and the orifice 197 in the braking piston 160. Oil pressure overcomes the force of spring 198 and pushes the rocker arm 210 up to rotate clockwise. The rocker arm 210 will stop the upward motion when the step 138*a* on the sleeve 163*a* contacts the step 138*b* on the sleeve 163*b*. The total travel or stroke of the braking piston 160 in the rocker arm 210 is 195, which will take up the gap 234 between the cam 230 and the cam follower 235. Now all the sleeves as well as the pistons are aligned, as shown in FIGS. 12B and 12D. Oil pressure overcomes the force of spring 177 and pushes the pistons 164*a*, 164*b* and 164*c* to the left and stopped by the spring seat 178*b* on the sleeve 163*a*. The braking piston 160 cannot move up in the rocker arm 210 but locked to the operative position. A mechanical linkage is formed by the coupled pistons and sleeves as shown in FIG. 12D. All the cam motion is transmitted to the exhaust valves 300 for the engine braking operation.

If the engine brake actuation means 100 is reset or turned off, the oil pressure on the piston 164*c* will drop faster than that on the braking piston 160 because orifices 197*o* in the sleeve 163*b* are blocked by the piston 164*b*. Higher oil pressure above the braking piston 160 pushes the steps 138*a* and 138*b* on the sleeves 163*a* and 163*b* against each other and helps reducing the friction force on the sliding pistons 164*a* and 164*c* so that the force of the spring 177 is high enough to push the pistons right to the decoupled or inoperative position. Then the groove 197*g* in the piston 164*b* will align with the orifices 197*o* in the sleeve 163*b* and the oil above the braking piston 160 can flow out so that the braking piston 160 will return to the inoperative position as shown in FIG. 12A.

Figure 13A:
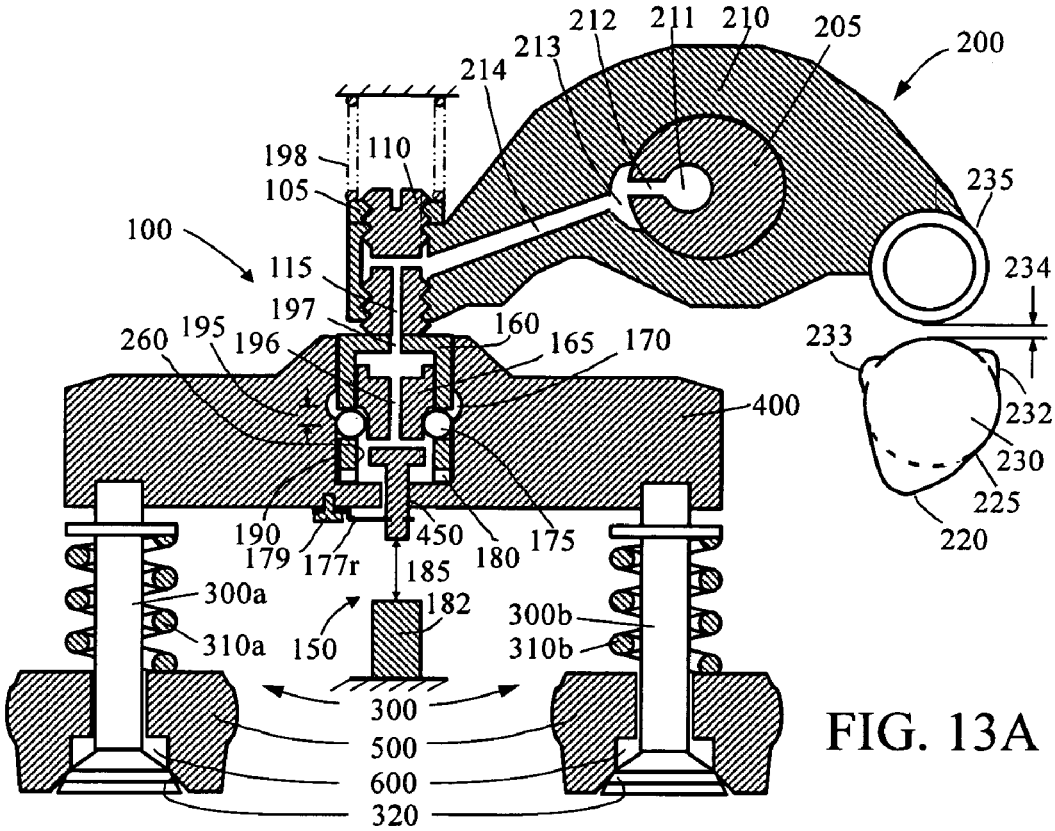
FIGS. 13A and 13B are schematic diagrams of an engine braking apparatus at the "Off" and "On" positions according to an eighth embodiment of the present invention.
Figure 13B:
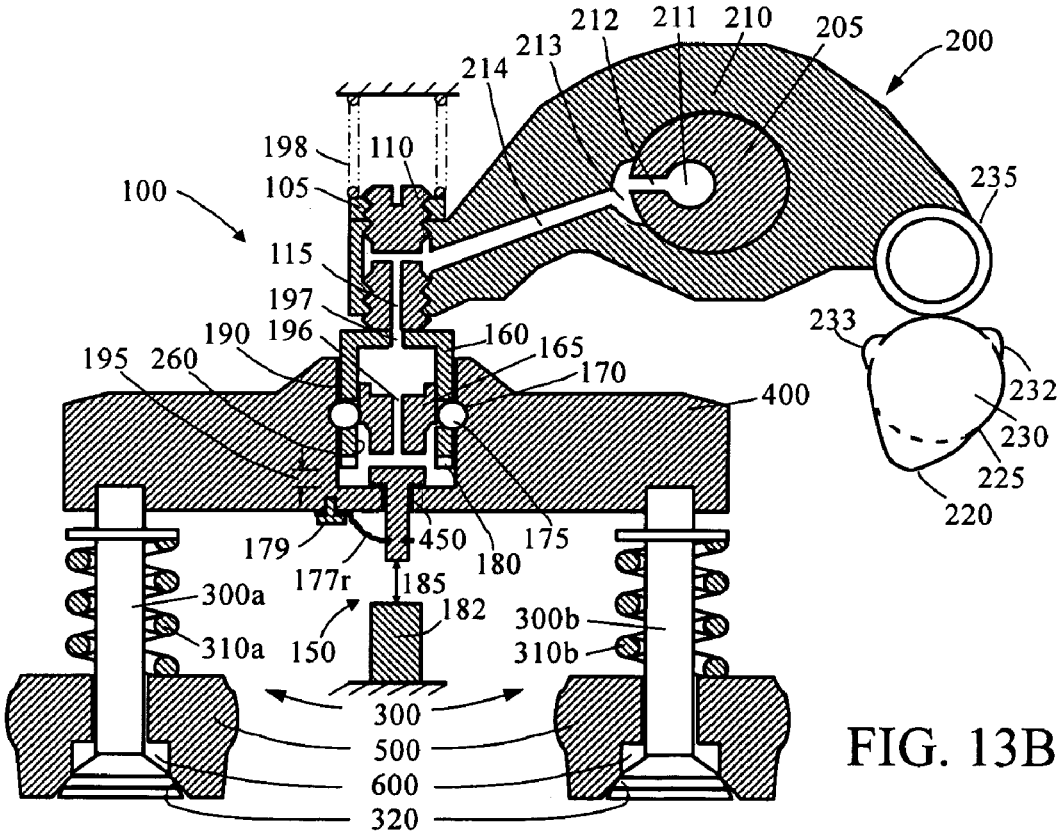

FIGS. 13A and 13B show a similar embodiment to that shown in FIGS. 9A and 9B except that the engine brake actuation means 100 is integrated into the valve bridge 400, not in the rocker arm 210. The engine brake reset means 150 is now a part of the actuation means 100, which includes a ball-locking piston 165 and a reset stop 182. The ball-locking piston 165 can slide in the bore 260 in the braking piston 160. The reset stop 182 is below the ball-locking piston 165 and fixed on the engine cylinder head 500. The lash adjusting mechanism includes a lash adjusting screw 110 secured on the rocker arm 210 by a lock nut 105.

During the normal engine operation or when engine braking is not needed, the engine brake control means 50 is turned off (FIG. 4B) and there is little or no oil pressure acting on the engine brake actuation means 100. The rocker arm 210 is biased against the braking piston 160 towards the valve bridge 400 by the spring 198. The engine brake actuation means 100 is at the inoperative position. A gap 234 is formed between the cam 230 and the cam follower 235 as shown in FIG. 13A, and part of the cam motion, i.e., from the small cam lobes 232 and 233 is skipped. Only the remaining part of the motion, i.e., from the higher portion of the enlarged cam lobe 220 is transmitted to the exhaust valves 300 to produce the main valve lift profile. At the same time, the ball-locking piston 165 is biased up by a spring 177*r* and a gap 185 is formed between the ball-locking piston 165 and the reset stop 182. The gap 185 is so designed that the ball-locking piston 165 will not touch the reset stop 182 during the normal engine operation.

When engine braking is needed, the engine brake control means 50 is turned on (FIG. 4A) to supply engine oil to the underneath of the braking piston 160 through the engine braking fluid circuit including the flow passage 115 in the lash adjusting screw 110, an orifice 197 on top of the engine braking piston 160, and a flow passage 196 in the ball-locking piston 165 (FIG. 13A). Oil pressure overcomes the force of spring 198 and pushes up the braking piston 160 with the rocker arm 210 pivoting clockwise on the rocker shaft 205 to take up the gap 234. As the braking piston 160 slides up in the bore 190 in the valve bridge 400, the balls 175 will align with and move into the annular groove 170 in the valve bridge 400 under the urge of the ball-locking piston 165 that is forced down by the oil pressure overcoming the force of spring 177*r* mounted on the valve bridge 400 by a screw 179. The ball-locking piston 165 is now seating on the bottom of the bore 190 in the valve bridge 400, and the balls 175 are locked into the groove 170 by the larger outer diameter surface of the ball-locking piston 165 (FIG. 13B). Now the ball-locking device is locked to the extended position or operative position with a lift 195 that is designed to take up the gap 234 to form a mechanical linkage. The motion from the whole cam 230 is picked up by the rocker arm 210, but not necessarily transmitted to the exhaust valves 300 due to the engine brake reset means 150.

The maximum downward motion of the valve bridge 400 and the braking piston 160 by the enlarged cam lobe 220 is larger than the gap 185. The ball-locking piston 165 in the braking piston 160 will touch the reset stop 182 and stop moving downward before the valve bridge 400 reaches its maximum lift. Therefore, the ball-locking piston 165 is also the resetting piston. A relative motion is created between the ball-locking piston 165 and the braking piston 160 and the ball-locking device is unlocked from the extended (operative) position back to the retracted (inoperative) position. The braking piston 160 drops to the bottom of the bore 190 in the valve bridge 400 and a portion of the valve lift equal to the gap height 195 (FIG. 13B) will be truncated or lost to switch the enlarged main valve lift profile to the main valve lift profile. Once the cam rotation passes the large cam lobe 220, the rocker arm 210 will pivot clockwise, the valve bridge 400 and the braking piston 160 will move up. The ball-locking piston 165 will separate from the reset stop 182. When the cam lift gets into the bottom part of the enlarged cam lobe 220 or below the peak lift of the small lobes 232 and 233, the ball-locking device will be extended and locked to the operative position again when the cam 230 rotates on the IBC 225 in front of the small cam lobe 232. Therefore, with the reset means 150 the engine valve lift profile for the engine braking operation will have all the valve lifts from the small cam lobes 232 and 233 but a truncated valve lift from the enlarged cam lobe 220.

The engine brake reset means 150 may work without the reset spring 177*r* because the ball-locking piston 165 can be unseated by the reset stop 182 to reset and turn off the engine brake actuation means 100. When the ball-locking piston 165 is unseated, there may be oil leakage through the annular gap between the small piston or stem of the ball-locking piston 165 and the bore 450 in the valve bridge 400. The engine brake reset means 150 can also be disabled by removing the reset stop 182, then the motion of the whole cam is transmitted to the exhaust valves 300 to produce an enlarged main valve lift profile and a secondary valve lift profile for the engine braking operation. Without the reset stop 182, the reset spring 177*r* is needed to unlock the ball-locking device and turn off the engine brake. Also, the reset stop 182 could be a variable. It can be actuated to vary the gap 185 to get different reset valve lift profiles. It can also sit on a spring. The spring force is large enough to reset the ball-locking device, but small enough to avoid hard clash to cause any engine damage due to improper design.

Figure 14A:
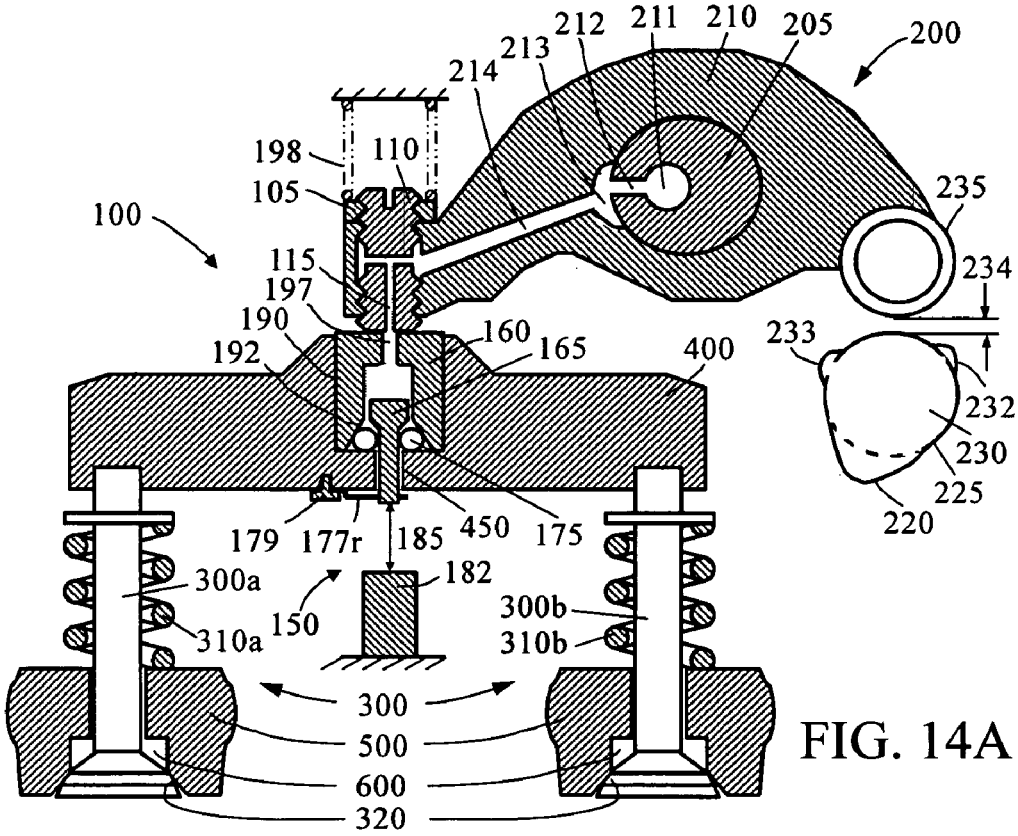
FIGS. 14A and 14B are schematic diagrams of an engine braking apparatus at the "Off" and "On" positions according to a ninth embodiment of the present invention.
Figure 14B:
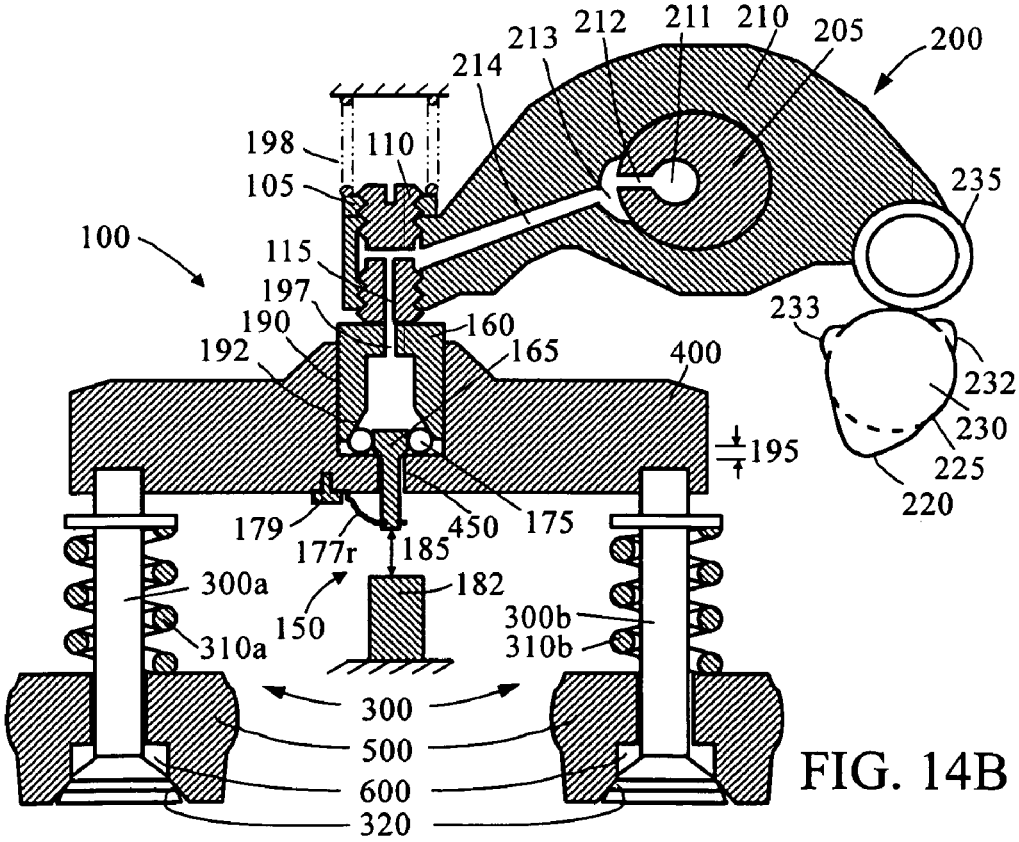

FIGS. 14A and 14B are schematic diagrams of another embodiment of the present invention with the engine brake actuation means 100 integrated into the valve bridge 400. The engine brake actuation means 100 is a ball-locking device similar to that shown in FIGS. 8A and 8B. A plurality of balls 175 are restrained by three surfaces on three different elements of the engine brake actuation means 100. The first surface is the tapered surface 192 on the braking piston 160 that is slidably disposed in a large bore 190 in the valve bridge 400. The second surface is the bottom flat surface of the bore 190, and the third surface on the ball-locking piston or plunger 165 that is slidably disposed in a small bore 450 in the valve bridge. The engine brake reset means 150 includes the ball-locking piston 165 and a reset stop 182 on the engine cylinder head 500.

The engine braking operation including the resetting mechanism of this embodiment is similar to the embodiment shown in FIGS. 13A and 13B and not described here for simplicity.

Figure 15:
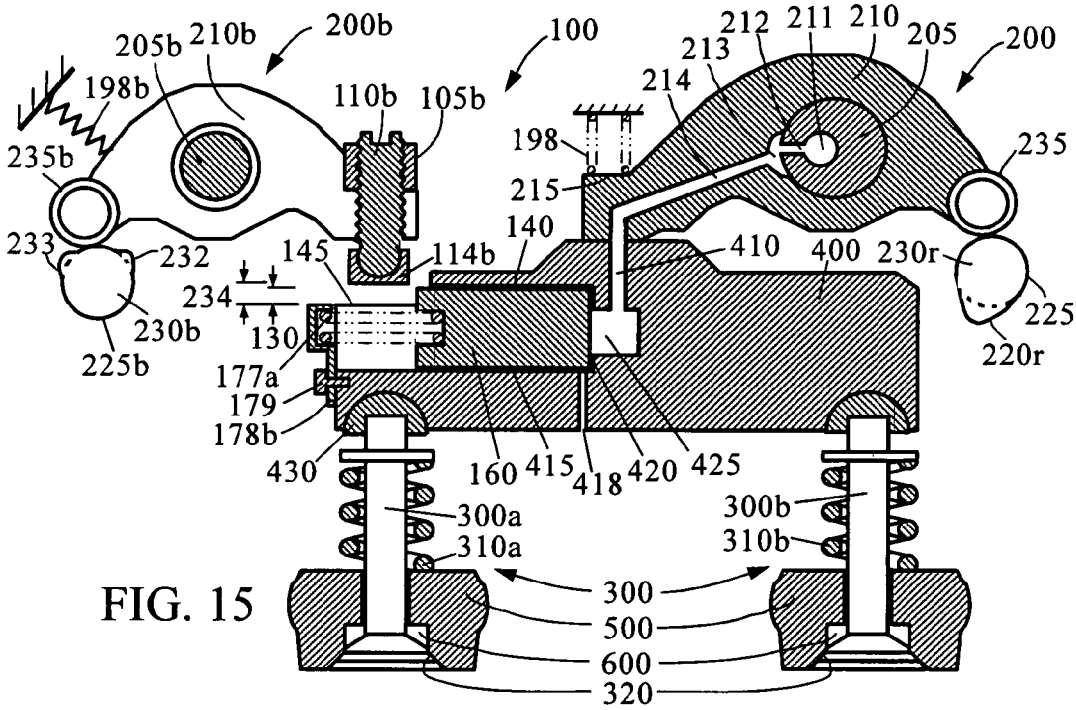
FIG. 15 is a schematic diagram of an engine braking apparatus at the "Off" position according to a tenth embodiment of the present invention.

FIG. 15 is a schematic diagram of another embodiment of the present invention. The engine brake actuation means 100 includes a dedicated valve lifter 200*b* and a hydraulic system integrated in the exhaust valve train. The hydraulic system includes a piston-sliding device with a braking piston 160 slidably disposed in the valve bridge 400 between an inoperative position and an operative position. The braking piston 160 contains an operative surface 140 commensurate with the operative position for the engine braking operation. The inoperative surface 145 commensurate with the inoperative position for the normal engine operation is on the valve bridge 400 and separated from the elephant foot 114*b* by a gap 234. The gap 234 is equal to or slightly larger than the height difference 130 between the two surfaces 140 and 145. The braking piston 160 is biased to the inoperative position by a spring 177*a*. One end of the spring 177*a* is on the braking piston 160 and the other end on a spring seat 178*b* that is secured on the valve bridge 400 by at least one screw 179. Seat 178*b* is also used as a stop to the braking piston 160, which limits the travel of the braking piston 160.

The dedicated braking valve lifter 200*b* includes a dedicated cam 230*b*, a cam follower 235*b*, a rocker arm 210*b*, and a lash adjusting system containing the adjusting screw 110*b*, the lock nut 105*b*, and the elephant foot 114*b*. The braking cam 230*b* only has the small cam lobes 232 and 233 above the IBC 225*b* for the engine braking operation, while the standard exhaust cam 230*r* has only the regular exhaust lobe 220*r* above the IBC 225 for the normal engine operation. Only one exhaust valve 300*a* is used for engine braking. The engine braking valve train is formed by the dedicated braking valve lifter 200*b* and the exhaust valve 300*a*.

When engine braking is needed, the engine brake control means 50 is turned on (FIG. 4A) to allow engine oil to flow through the engine braking fluid circuit and into a pressure chamber 425 in the valve bridge 400 as shown in FIG. 15. The engine oil pressure overcomes the preload of the spring 177*a*, and pushes the braking piston 160 out of the bore 415 in the valve bridge 400 from the retracted position to the extended position. The braking piston 160 is stopped at the spring seat 178*b*, and the operative surface 140 on the braking piston 160 is under the elephant foot 114*b*. Now the braking piston 160 is fully extended to the operative position and the gap 234 in the engine braking valve train is taken up to form a mechanical linkage. All the cam motion, from the dedicated braking cam 230*b* and the standard exhaust cam 230*r*, is transmitted to the exhaust valves 300*a* and 300*b*. There is no hydraulic compliance from hydraulic linkage as used by prior art engine braking systems.

When engine braking is not needed, the engine brake control means 50 is turned off (FIG. 4B) and there will be little or no oil supplied to the engine braking fluid circuit. The oil pressure in the chamber 425 is not high enough and the braking piston 160 will be pushed back into the valve bridge 400 by the spring 177*a*. The braking rocker arm 210*b* is biased against the braking cam 230*b* and away from the inoperative surface 145 by a spring 198*b*. The gap 234 in the valve train as shown in FIG. 15 is formed. Now the braking piston is retracted and disengaged from the dedicated braking valve lifter 200*b*. Part of the cam motion, i.e., from the braking cam lobes 232 and 233 is skipped. Only the motion from the standard exhaust cam 230*r* is transmitted to the exhaust valves 300 for the normal engine operation.

Note that the bleeding orifice 418 in the valve bridge 400 is optional and used as a flow draining means for turning off the engine brake faster or eliminating the need of the drain port 222 in FIGS. 4A and 4B so that a two-way solenoid valve may be used to replace the three-way solenoid valve 51. Spring 198 may be desirable, for example, at the top surface 215 of the rocker arm 210, to bias the rocker arm 210 against the valve bridge 400 for a better sealing of the fluid from the passage 214 in the rocker arm to the passage 410 in the valve bridge 400.

The embodiment as shown in FIG. 15 could be modified or varied without departing from the scope and spirit of the present invention. For instance, both the operative surface 140 and the operative surface 145 can be on the braking piston 160; the operative surface 140 can take different type, such as a flat surface, and the braking piston motion can be guided. Also, the cam shaft for the engine braking cam 230*b* can be a separate one or the same one as for the normal exhaust cam 230*r*, and the rocker arm shaft for the engine braking rocker arm 210*b* can be a separate one 205*b* or the same one 205 as for the normal rocker arm 210. The spring 198*b* can also take a different type, for example, a flat or leaf spring, or a torsion spring.

Figure 16:
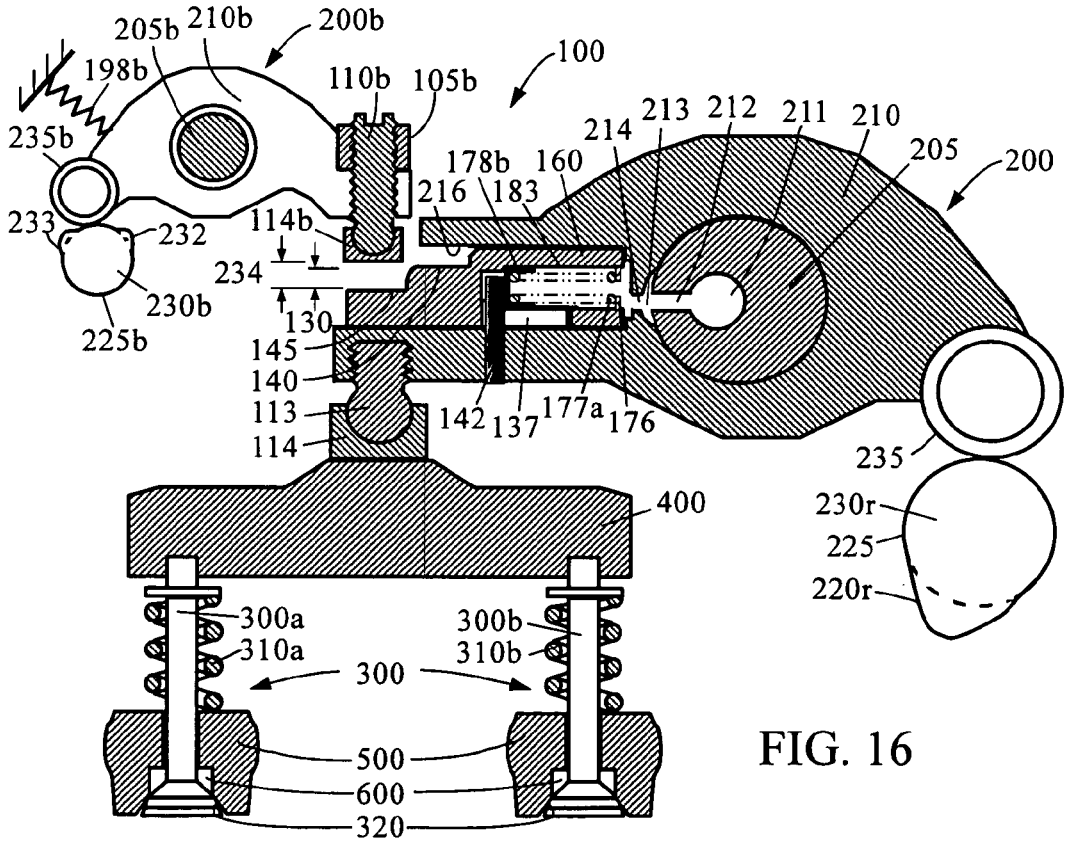
FIG. 16 is a schematic diagram of an engine braking apparatus at the "Off" position according to an eleventh embodiment of the present invention.

FIG. 16 shows a similar embodiment to that shown in FIG. 15 except that the braking piston 160 is integrated into the rocker arm 210 so that both of the two exhaust valves 300*a* and 300*b* will be open during the engine braking operation. Also the braking piston 160 and the way it is assembled in the rocker arm 210 are different.

The braking piston 160 contains a first surface 140 commensurate with the operative position and a second surface 145 commensurate with the inoperative position. The two surfaces are two flat cuts on the braking piston 160 and have a height difference 130. The braking piston 160 is biased into the bore 216 in the rocker arm 210 to the inoperative position by the braking spring 177*a*. One end of the braking spring 177*a* sits on a spring seat 176 mounted on the braking piston 160. The other end of the spring 177*a* sits on another spring seat 178*b* slidable disposed in a bore 183 in the braking piston 160. The spring seat 178*b* is normally stopped by a pin 142 fixed in the rocker arm 210. There is a slot or axial cut 137 across the bore 183 in the braking piston 160, which has a width slightly larger than the pin 142. The pin 142 and the slot 137 form a motion limiting means to control the movement of the braking piston 160 between the inoperative position and the operative position. They also form an anti-rotation means to guide the braking piston 160 so that the first and second surfaces 140 and 145 always face upward to the elephant foot 114*b*.

The engine braking operation of this embodiment is very similar to the embodiment shown in FIG. 15 and is not described here for simplicity.

Figure 17:
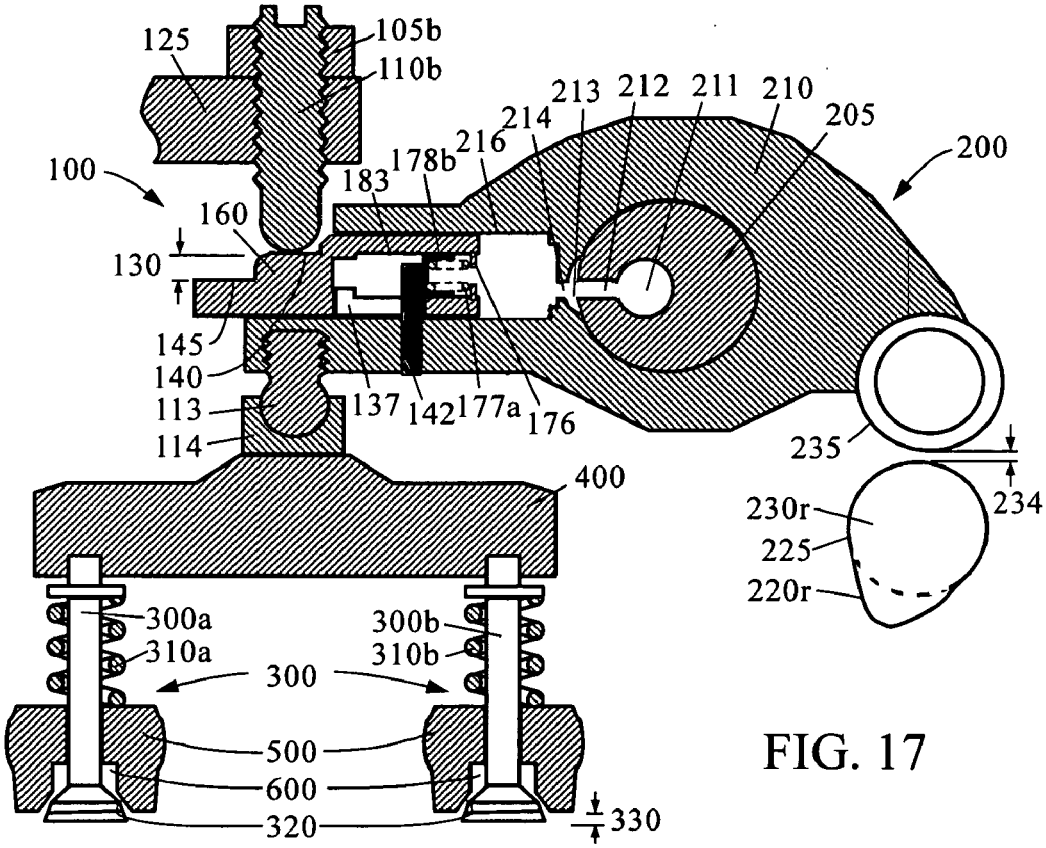
FIG. 17 is a schematic diagram of an engine braking apparatus at the "On" position according to a twelfth embodiment of the present invention.

FIG. 17 is a schematic diagram of an engine braking apparatus at its "On" position according to a variation from the embodiment shown in FIG. 16. There are two major changes. First, the dedicated braking valve lifter 200*b* in FIG. 16 is replaced by an engine brake housing 125 mounted on the engine. Second, the cam 230 containing the enlarged exhaust cam lobe 220 as well as the small braking cam lobes 232 and 233 is replaced by the regular cam 230*r* containing only the regular exhaust cam lobe 220*r*. Therefore, the embodiment shown in FIG. 17 is for BTEB, while the one in FIG. 16 is for CREB.

When engine braking is needed, the engine brake control means 50 is turned on (FIG. 4A) to allow engine oil to flow through the engine braking fluid circuit and into the bore 216 in the rocker arm 210. As the cam 230*r* pushes the rocker arm 210 rotating anticlockwise to open the exhaust valves 300, the braking piston 160 will move down with the rocker arm 210 and away from the lash adjusting screw 110*b*. The engine oil pressure overcomes the preload of the spring 177*a* and pushes the braking piston 160 out of the bore 216 from the inoperative position to the operative position as shown in FIG. 17. The braking piston 160 is stopped at the pin 142 fixed in the rocker arm 210, and the operative surface 140 on the braking piston 160 is under the adjusting screw 110*b*. As the cam 230*r* continues its rotation and passes the peak of the cam lobe 220*r*, the rocker arm will rotate clockwise and the braking piston 160 will move up towards the adjusting screw 110*b*. Due to the height difference 130 between the operative surface 140 and the inoperative surface 145, the exhaust valves 300 could not return to their seats 320 but are held open for the BTEB. The braking valve opening is 330 and about 0.4 to 2.0 mm, much smaller than the normal exhaust valve opening (>10 mm). Corresponding to the braking valve opening 330, there is a gap 234 between the cam 230*r* and cam follower 235 since the rocker arm 210 is also stopped by the lash adjusting screw 110*b* through the braking piston 160 and cannot fully return to its regular top position. Therefore, the engine braking load is not passed to the exhaust valve train, e.g., rocker arm 210 and cam 230*r*, but to the housing 125 mounted on the engine.

When engine braking is not needed, the engine brake control means 50 is turned off (FIG. 4B) and there will be little or no oil supplied to the engine braking fluid circuit. The oil pressure in the bore 216 is not high enough to overcome the force by spring 177*a* and the braking piston 160 will be pushed back into the bore 216 to the inoperative position. The inoperative surface 145 now is under the valve lash adjusting screw 110*b* with a regular exhaust valve lash between them, and the braking piston 160 will not contact the lash adjusting screw 110*b* during the whole cam rotation. The exhaust valves 300 will return to their seats 320 and there will be no gap 234 between the cam and cam follower. Now the actuation means 100 is at the inoperative position and disengaged from the normal engine operation.

Figure 18:
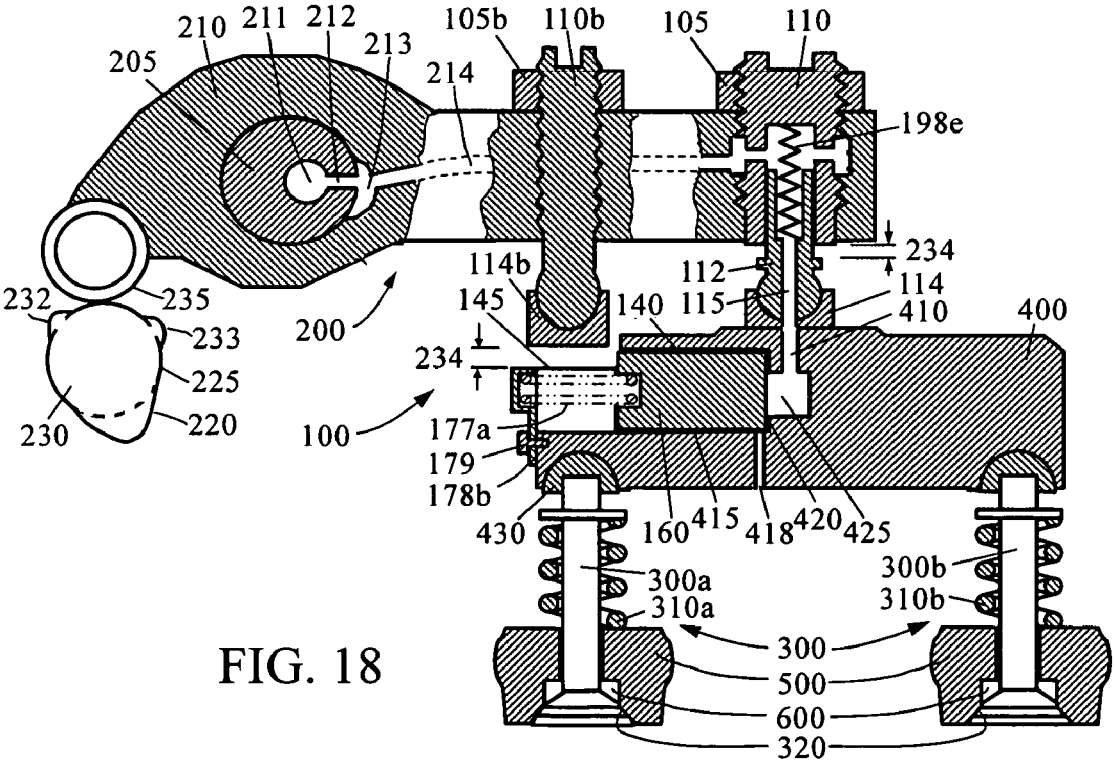
FIG. 18 is a schematic diagram of an engine braking apparatus at the "Off" position according to a thirteenth embodiment of the present invention.

FIG. 18 is a schematic diagram of an engine braking apparatus at the "Off" position according to a variation from the embodiment shown in FIG. 15. Instead of using a dedicated braking valve lifter 200*b*, the braking valve lifter of the engine brake actuation means 100 is integrated into the exhaust valve lifter 200. The braking cam 230*b* and the regular cam 230*r* in FIG. 15 are combined into a new cam 230 shown in FIG. 18. The new cam 230 contains the small braking cam lobes 232 and 233 as well as an enlarged exhaust cam lobe 220. The lower portion of the enlarged exhaust cam lobe 220 has about the same height as the small cam lobes 232 and 233, while the higher portion is about the same as the regular exhaust cam lobe 220*r*. A spring 198*e* is put between the lash adjusting screw 110 and the lash adjusting piston 112 to prevent no-follow of the exhaust valve train components. A different type of spring, for example, a flat spring or a torsion spring, can be used and be put at different location as long as the same purposes can be achieved. A gap 234 is designed between the lash adjusting screw 110 and the lash adjusting piston 112 so that part of the motion from the cam 230 including the small braking cam lobes 232 and 233 is skipped during the normal engine operation.

The engine braking operation of this embodiment is similar to the embodiment shown in FIG. 15 and only the difference is described here. The exhaust valve (the braking valve) 300*a* is opened earlier by the lower portion of the enlarged cam lobe 220 through the braking elephant foot 114*b*, while the other (the non-braking valve) 300*b* opened later by the higher portion of the enlarged cam lobe 220 through the regular elephant foot 114 due to the gap 234. By the same token, the braking valve 300*a* will be closed later than the non-braking valve 300*b*. Therefore, there will be a small tilt of the valve bride 400, which will create an unbalanced loading condition when the regular elephant foot 114 acts on the valve bridge 400 opening both exhaust valves 300. The universal pad 430 is provided between the valve bridge 400 and the valves 300 to better handle the unbalanced load on the exhaust valves 300. Also, the braking load is passed to the exhaust valve lifter 200.

The engine braking apparatus shown in FIG. 18 can be easily converted from the compression release type engine braking to the bleeder type engine braking. First, replace the cam 230 with the regular cam 230*r* shown in FIG. 17. Second, eliminate the gap 234 between the lash adjusting screw 110 and the lash adjusting piston 112. The next example will show how a fully integrated bleeder type engine brake works.

Figure 19A:
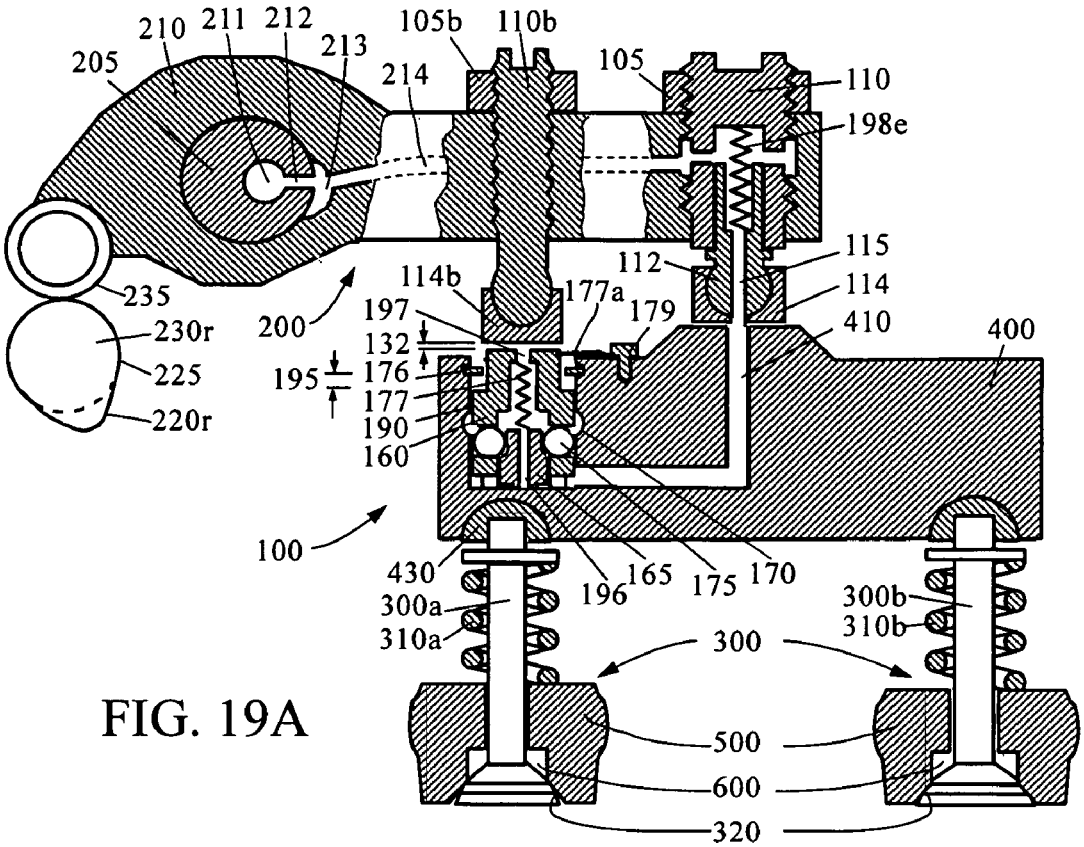
FIGS. 19A and 19B are schematic diagrams of an engine braking apparatus at the "Off" and "On" positions according to a fourteenth embodiment of the present invention.
Figure 19B:
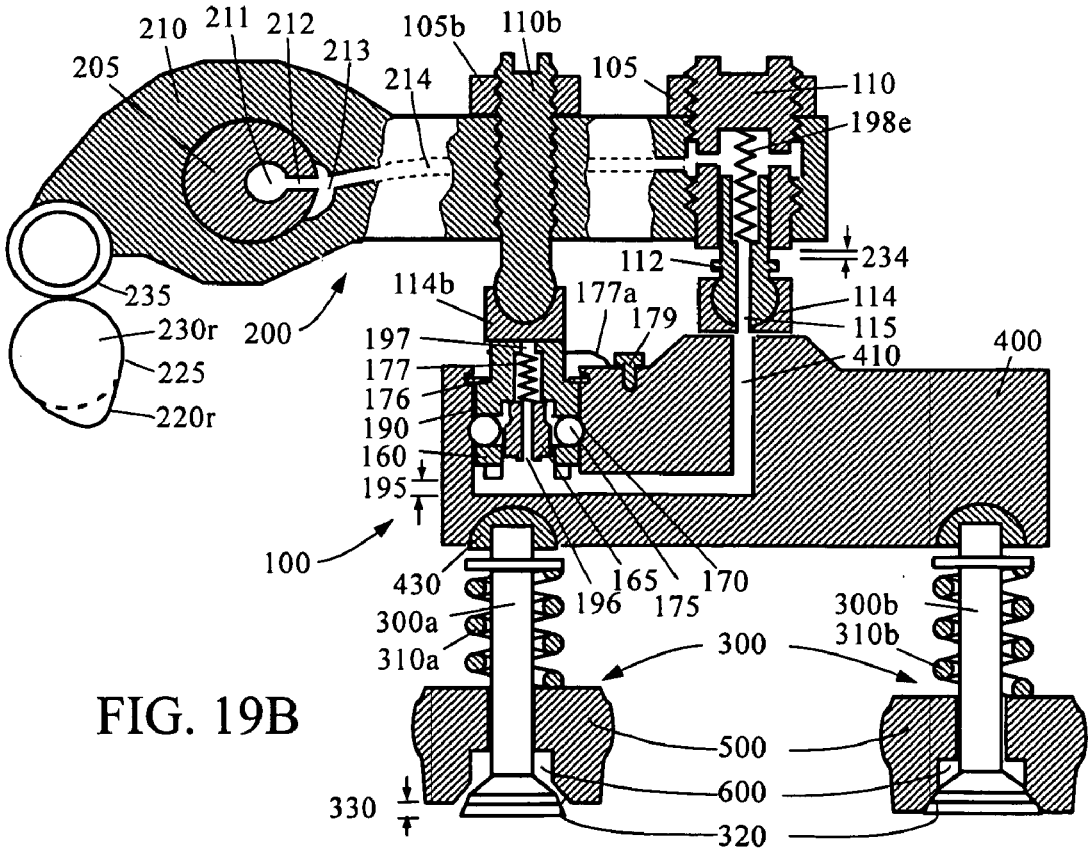

FIGS. 19A and 19B are schematic diagrams of an engine braking apparatus at the "Off" and "On" positions according to another embodiment of the present invention. The regular exhaust cam 230*r* is used. Therefore, this is a bleeder type engine brake opening one exhaust valve for engine braking. A ball-locking device similar to that shown in FIGS. 10A and 10B is disposed slidably in the valve bridge 400 and below the braking elephant foot 114*b*.

When engine braking is needed, the control means 50 is turned on (FIG. 4A) to supply engine oil to the engine brake actuation means 100 through the engine brake fluid circuit. Oil pressure overcomes the force of spring 177*a* and pushes upwards the braking piston 160 as well as the ball-locking piston 165. As the cam 230 rotates, the braking piston 160 will move down with the valve bridge 400 and further away from the braking elephant foot 114*b*. Before the cam rotation reaches the peak lift of the cam lobe 220*r*, the braking piston 160 will be fully extended out of the bore 190 and to the clip ring 176. During the upward motion of the braking piston 160, the balls 175 contained in the braking piston 160 will align with and move into the annular groove 170 in the valve bridge 400. Once the balls 175 are in the groove 170, the ball-locking piston 165 will move up because the oil pressure overcomes the force of spring 177. The balls 175 are locked into the groove 170 by the larger outer diameter surface of the ball-locking piston 165 to form a mechanical linkage between the braking piston 160 and the valve bridge 400 (FIG. 19B). The braking piston 160 is now at the extended or operative position with a stroke 195 that is larger than the initial valve lash 132 (FIG. 19A). After the cam rotation passes the peak lift of the cam lobe 220*r*, the braking piston 160 will move up with the valve bridge 400 as well as the exhaust valves 300. However, the braking exhaust valve 300*a* cannot return to its seat 320 but is held open due to the mechanical linkage (FIG. 19B). The braking valve opening 330 is equal to the difference between the braking piston stroke 195 and the initial valve lash 132 (FIG. 19A).

When engine braking is not needed, the control means 50 is turned off (FIG. 4B) and there will be little or no oil pressure acting on the ball-locking piston 165, which will slide down in the braking piston 160 under the force of spring 177. The balls 175 will move inwards and out of the annular groove 170, and the braking piston 160 will move down under the force of spring 177*a*. Now the ball-locking device is at the retracted or inoperative position as shown in FIG. 19A and the engine braking actuation means is disengaged from the normal engine operation. The orifice or flow passage 196 in the ball-locking piston 165 is optional, and could be used to turn off the engine brake.

Figure 20:
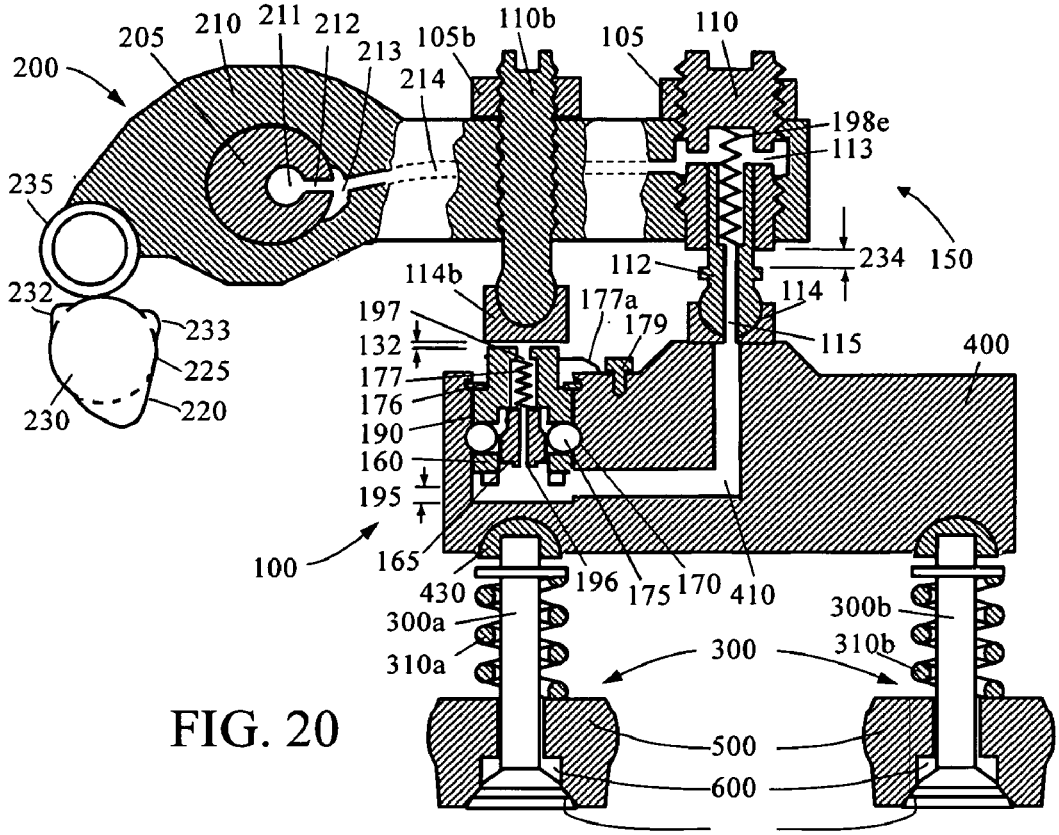
FIG. 20 is a schematic diagram of an engine braking apparatus at the "On" position according to a fifteenth embodiment of the present invention.

FIG. 20 is a schematic diagram of an engine braking apparatus at the "On" position according to an embodiment that combines some of the features shown in FIG. 18 and FIGS. 19A and 19B. The same braking cam 230 as shown in FIG. 18 is used, which contains the small braking cam lobes 232 and 233 as well as the enlarged exhaust cam lobe 220. The same ball-locking device as shown in FIGS. 19A and 19B is used. The new feature of this embodiment is from the reset means 150 that is incorporated into the actuation means 100. The lash adjusting piston 112 also acts as a reset piston to block the oil flow to the braking piston 160, and the orifices 196 and 197 in the ball-locking device serve as draining passage for the resetting.

During the engine braking operation, oil pressure overcomes the force of spring 177*a* and pushes the ball-locking device to the operative position to form a mechanical linkage (FIG. 20). The braking valve lash 132 between the braking piston 160 and the elephant foot 114*b* is slightly larger than the regular exhaust valve lash. As the cam 230 rotates, the small braking cam lobes 232 and 233 push the braking valve 300*a* open due to the mechanical linkage. The non-braking valve 300*b* is still closed due to the gap 234 between the lash adjusting screw 110 and the lash adjusting piston 112. The lower portion of the enlarged cam lobe 220 will also open the braking valve 300*a* but not the non-braking valve 300*b*. But the higher portion of the enlarged cam 220 will act on the valve bridge 400 to open both of the two exhaust valves 300 because the gap 234 is taken up by the lower portion of the enlarged cam lobe 220. Therefore, the braking valve 300*a* opens earlier and closes later than the non-braking valve 300*b*. There will be a small tilt of the valve bride 400, which will create an unbalanced loading on the two exhaust valves 300.

The reset means 150 is designed here to address the unbalanced loading issue. When the lash adjusting screw 110 touches the shoulder of the lash adjusting piston 112, the gap 234 is eliminated and the flow passage 113 in the lash adjusting screw 110 is blocked. Oil under the braking piston 160 will bleed out of the orifices 196 and 197 under the load of spring 177*a*. The braking piston 160 will retract into the bore 190 and separate from the elephant foot 114*b*. The braking valve 300*a* will return to its seat 320 with the same closing timing as the non-braking valve 300*b*. If the braking piston 160 were still extended without the resetting, the braking elephant foot 114*b* would act on it and the braking valve 300*a* would close much later than the non-braking valve 300*b*. When the rocker arm 210 continues its anti-clockwise rotation after the valves 300 are seated, the gap 234 is re-formed and the flow passage 113 is unblocked so that oil can refill the ball-locking device. The braking piston 160 will be fully extended during the cam IBC 225 in front of the small braking cam lobes 232 and 233 so that their motion can be transmitted to the braking valve 300*a*, and the engine braking cycle repeats. Therefore, the reset means 150 will modify the valve lift profile produced by the enlarged cam lobe 220, not that by the small braking cam lobes 232 and 233.

Figure 21:
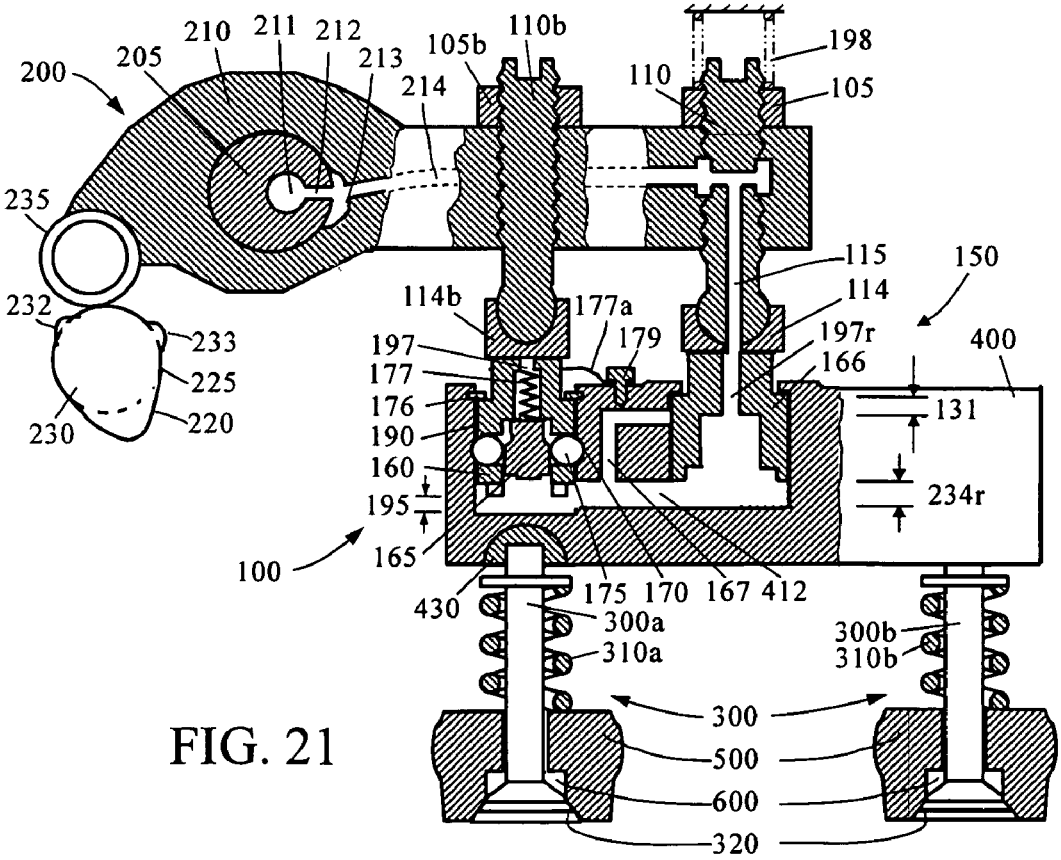
FIG. 21 is a schematic diagram of an engine braking apparatus at the "On" position according to a sixteenth embodiment of the present invention.

FIG. 21 shows a different version of the embodiment in FIG. 20 with a different reset means 150. A reset piston 166 is slidably disposed in the valve bridge 400 below the elephant foot 114. The reset piston 166 as well as the rocker arm 210 is biased to the valve bridge 400 by a spring 198 to prevent no-follow of any exhaust valve train components. A reset flow passage 167 is also added in the valve bridge 400, and there is no more need for a bleeding orifice in the ball-locking piston 165.

When engine braking is needed, the control means 50 is turned on (FIG. 4A) to allow engine oil to flow to the reset piston 166 and the ball-locking device through the brake fluid circuit that further includes the flow passage 197*r* in the reset piston 166. Oil pressure overcomes the loads of spring 198 and spring 177*a* and pushes the reset piston 166 and the braking piston 160 upwards to rotate the rocker arm 210 anti-clockwise towards the cam 230. The braking system is now at the "On" or operative position as shown in FIG. 21. The braking piston 160 is stopped at the clip ring 176 with a stroke of 195 that takes up the lash or gap between the elephant foot 114*b* and the braking piston 160. The reset piston has a stroke of 234*r* corresponding to the gap 234 that would show up between the cam follower 235 and the cam 230 if the braking system were at the "Off" position. As the cam 230 rotates, the motion from the small braking cam lobes 232 and 233 is transmitted to the exhaust valve 300*a* through the braking piston 160, the valve bridge 400, and the universal pad 430 for the engine braking operation, since the braking piston 160 is extended and mechanically locked to the operative position by the ball-locking piston 165. The motion from the small braking cam lobes 232 and 233 is not transmitted to the other exhaust valve 300*b* because of the gap 234*r* between the reset piston 166 and the valve bridge 400. The oil under the reset piston 166 is pushed back through the flow passage 197*r*. An accumulator may be needed in the braking fluid circuit to absorb the flow pumped back by the reset piston 166.

Once the cam rotation gets into the higher portion of the enlarged cam lobe 220, the reset piston 166 will touch the valve bridge 400 and act on both exhaust valves 300*a* and 300*b*. But before the reset piston 166 touches the valve bridge 400, it will open the reset flow passage 167 since the reset height 131 is smaller than the gap 234*r*. The oil under the braking piston 160 will drain out of the passage 167 and the braking piston 160 will retract into the bore 190 under the load of spring 177*a*. The opened braking exhaust valve 300*a* will return to its seat 320 and the titled valve bridge 400 will be leveled. There will be no unbalanced load when the reset piston 166 acts on the valve bridge 400 and open both exhaust valves 300*a* and 300*b* by the higher portion of the enlarged cam lobe 220. Once the valves 300 are seated, the rocker arm 210 will continue to rotate anti-clockwise and the reset piston 166 will move up in the valve bridge 400 under oil pressure to block the reset flow passage 167 so that oil can refill and push out the ball-locking device. The ball-locking device will be fully extended to the operative position during the cam IBC 225 in front of the small braking cam lobes 232 and 233 so that their motion can be transmitted to the braking valve 300*a*, and the engine braking cycle repeats.

When engine braking is not needed, the control means 50 is turned off (FIG. 4B) and there will be little or no oil supplied to the ball-locking device. When the reset piston 166 moves down and opens the reset flow passage 167, the oil under the ball-locking device will drain out and the braking piston 160 will retract into the bore 190 under the load of spring 177*a*. The reset piston 166 is biased to the valve bridge 400 by the spring 198 to form a gap 234 between the cam follower 235 and the cam 230 to skip part of the cam motion, i.e., from the lower portion of the cam 230 including the braking cam lobes 232 and 233. The two exhaust valves 300 will be opened by the higher portion of the enlarged cam lobe 220 through the rocker arm 210, the reset piston 166 and the valve bridge 400. The retracted braking piston 160 will not touch the elephant foot 114*b* of the braking valve lash adjusting means during the whole cycle of cam rotation. The engine brake actuation means 100 is now at the inoperative position and disengaged from the normal engine operation.

CONCLUSION, RAMIFICATIONS, AND SCOPE

It is clear from the above description that the engine braking apparatus according to the embodiments of the present invention have one or more of the following advantages over the prior art engine braking systems:

(a) The apparatus can be installed on all types of engines;
(b) The apparatus has much faster response (on & off) time;
(c) The apparatus transmits force, or the engine braking load, through mechanical linkage means that does not have high compliance and overloading problems associated with hydraulic means used by the prior art engine brakes;
(d) The apparatus has no asymmetric loading on valves or valve bridge associated with some of the prior art engine brakes;
(e) The apparatus has fewer components, reduced complexity, and lower cost;
(f) The apparatus has a braking valve lash setting mechanism and thus reduced manufacturing tolerance requirements for the engine brake components;
(g) The apparatus is simple in construction, more reliable in operation, and effective at all engine speeds; and
(h) The apparatus does not affect normal engine performance.

While my above description contains many specificities, these should not be construed as limitations on the scope of the invention, but rather as an exemplification of the preferred embodiments thereof. Many other variations are possible. For example, the engine braking apparatus disclosed here can be applied to a push tube type engine instead of the overhead cam type engine. It can use one valve for engine braking instead of two valves.

Also, the spring 198 shown in FIG. 3A and other figures can sit at other locations or even between two engine valve train components, such as between the rocker arm 210 and the valve bridge 400, as far as the spring force is large enough to prevent valve train components from no-following during the normal engine operation and is small enough to allow the engine brake actuation means 100 to be actuated during the engine braking operation. The spring 198 can also take a different type than the coil spring, for example, a flat or leaf spring, a wavy spring, or a torsion spring.

Also, the engine brake actuation means 100 can be controlled (turned on and off) by other types of control means 50, such as a dedicated hydraulic system, a common rail system, and a pneumatic system. And a poppet type solenoid valve could be used to replace the spool type valve 51 of the control means 50 as shown in FIGS. 4A and 4B.

Also, the engine brake actuation means 100 can be integrated into other components of the existing valve train 200, such as the push tube for a push tube type engine, or even into the cam 230.

Also, the engine brake actuation means 100 can be integrated into a dedicated valve train 200*b* with a dedicated rocker arm 210*b* and a dedicated cam 230*b* that only contains small lobes 232 and 233 for auxiliary valve lift, while the main valve lift for the normal engine operation is produced by the existing valve train or valve lifter 200. The actuation means 100 has an inoperative position and an operative position. In the inoperative position, the actuation means 100 is retracted and disengaged from the engine valve 300; while in the operative position the actuation means 100 is extended and mechanically locked to open the engine valve 300 for a special engine valve event. The special engine valve event includes engine braking event, exhaust gas recirculation (EGR) event, and etc. The actuation means 100 is moved by the control means 50 between the inoperative position and the operative position.

Also, the mechanical linkage means can be other than the ball-locking device, such as a wedge or taper type mechanism, a step slider system, or a spring-actuated shrinking and expending system.

Also, the valve lift profile illustrated in FIG. 6 could be different. The BGR lift 232*v*, the CRB lift 233*v*, and the enlarged main valve lift 220*v* could be separated individual bumps or connected to each other. The braking valve event could be a compression release type engine brake with a CRB bump 233*v* around compression TDC plus a BGR bump 232*v* around intake BDC, or other types of engine braking, such as a partial cycle bleeder brake with a substantially constant valve lift throughout the compression stroke. There should be no valve lift during most of the intake stroke so that the engine brake actuation means 100 could be changed from the retracted position to the extended position. Accordingly, the small cam lobes 232 and 233 shown in FIG. 3A and other figures could be combined to form a single cam lobe with a substantially constant lift during the engine compression stroke for a partial cycle bleeder brake. The single cam lobe can even be extended to be connected to the enlarged cam lobe 220. Now the "single" cam lobe is in fact just a transition "step" to the enlarged cam lobe 220. In summary, the cam contains at least one small lobe and the at least one small lobe includes the constant lift type for a partial cycle bleeder brake.

Accordingly, the scope of the invention should be determined not by the embodiments illustrated, but by the appended claims and their legal equivalents.

I claim:

1. Apparatus for converting an internal combustion engine from a normal engine operation to an engine braking operation, said engine including an exhaust valve train comprising an exhaust valve, a valve bridge and a cam, said apparatus comprising:

(a) an actuator having a mechanical braking piston integrated into the valve bridge, said actuator having an inoperative position and an operative position; in said inoperative position said mechanical braking piston being retracted to form a gap between the exhaust valve and the cam, disengaged from the normal engine operation, and not subject to any load from the exhaust valve train; and in said operative position said mechanical braking piston being extended to take up said gap and to form a mechanical linkage for opening the exhaust valve for the engine braking operation, wherein the mechanical linkage has solid-to-solid contacts without a hydraulic linkage;

(b) a lash adjusting mechanism for adjusting only said gap formed by the retraction of said mechanical braking piston, and (c) a controller for moving said actuator between said inoperative position and said operative position to achieve the conversion between the normal engine operation and the engine braking operation.

2. The apparatus of claim 1 wherein said cam comprises a large cam lobe and a small cam lobe, said large cam lobe generating a large valve lift profile comprising a lower portion and a higher portion, said lower portion having approximately the same height as the valve lift profile generated by the small cam lobe, and said higher portion having approximately the same height as a regular valve lift profile for the normal engine operation.

3. The apparatus of claim 1 further comprising a hydro-mechanical reset mechanism for modifying the large valve lift profile, wherein during the higher portion of the large valve lift profile, said hydro-mechanical reset mechanism un-locks said actuator from the operative position to the inoperative position and resets the large valve lift profile to the regular valve lift profile, wherein said hydro-mechanical reset mechanism subjects to no electronic triggering from said controller in each braking cycle during the engine braking operation.

4. The apparatus of claim 1, wherein said cam is a first cam, the apparatus further comprising a second cam, wherein the first cam is one of a regular cam and a braking cam and the second cam is the other of the regular cam and braking cam, wherein the regular cam contains a regular cam lobe for the normal engine operation, and the braking cam contains a small cam lobe for the engine braking operation.

5. The apparatus of claim 1 wherein said actuation means further comprises a ball-locking device having a plurality of balls, a ball-locking piston, and a braking piston; said ball-locking device being movable between an extended position and a retracted position; in the extended position said ball-locking device being locked up to form a mechanical linkage for transmitting motion and load for the engine braking operation; and in the retracted position said ball-locking device being unlocked and pushed back to disengage from the at least one exhaust valve.

6. The apparatus of claim 1 wherein said actuator includes a piston-sliding device, said piston-sliding device having the mechanical braking piston, said mechanical braking piston being slidable between the inoperative position and the operative position; in the inoperative position said mechanical braking piston being retracted and disengaged from the exhaust valve; and in the operative position said mechanical braking piston being extended to form the mechanical linkage for transmitting motion and load to the exhaust valve for the engine braking operation.

7. The apparatus of claim 1, wherein in said inoperative position the mechanical braking piston is retracted to form a lash between said actuator and the at least one exhaust valve, and wherein in said operative position said mechanical braking piston being extended to eliminate the lash and to form the mechanical linkage between said actuator and the at least one exhaust valve.

8. The apparatus of claim 1 wherein said controller comprises an electro-hydro-mechanical system; said electro-hydro-mechanical system comprising a fluid circuit formed in said actuator and in said engine, and a flow control device for supplying and cutting off a fluid flow to said actuator through said fluid circuit; and said fluid flow controlling the motion of said actuator between the inoperative position and operative position.

9. The apparatus of claim 8 wherein said flow control device comprises a solenoid valve.

10. The apparatus of claim 8 wherein said flow control device further comprises an additional flow drain to said fluid circuit of said electro-hydro-mechanical system for assisting turning off said engine braking operation.

11. The apparatus of claim 10, wherein said additional flow drain comprises a reset mechanism for resetting the larger valve lift profile to the regular valve lift profile in each braking cycle during the engine braking operation.

12. The apparatus of claim 10 wherein said additional flow drain is opened and closed on the basis of the position of the exhaust valve in each braking cycle.

13. A method of modifying engine valve lift in an internal combustion engine, said engine including an engine valve train comprising an engine valve, a valve bridge and a cam, said method comprising the steps of:

(a) providing an actuator having a mechanical braking piston integrated with the valve bridge, said actuator having an inoperative position and an operative position; in said inoperative position said mechanical braking piston being retracted to form a gap between the engine valve and the cam, and disengaged from the engine valve, and in said operative position said mechanical piston being extended to take up said gap and to form a mechanical linkage for opening the e engine valve, wherein the mechanical linkage has solid-to-solid contacts without a hydraulic linkage;

(b) providing a lash adjusting mechanism for adjusting said gap formed by the retraction of said mechanical piston;

(c) providing a controller for moving said actuator between said inoperative position and said operative position;

(d) turning on said controller;

(e) moving said actuator from said inoperative position to said operative position to take up said gap and to form the mechanical linkage; and (f) transmitting the motion from the cam to the engine valve through the mechanical linkage.

14. The method of claim 13 further comprising the steps of:

(a) turning off said controller;

(b) moving said actuator from said operative position to said inoperative position to form said gap and to break the mechanical linkage; and (c) skipping part of the motion from the cam, while transmitting remaining part of the motion from the cam to the engine valve.

15. The method of claim 13 further comprising the steps of:

(a) providing a hydro-mechanical reset mechanism for modifying the engine valve lift, wherein said hydro-mechanical reset mechanism subjects to no electronic triggering from said controller in each engine cycle during the modification of the engine valve lift;

(b) engaging said hydro-mechanical reset mechanism after the engine valve lift gets into its top portion;

(c) un-locking said actuator from the operative position to the inoperative position while the engine valve lift being still in the top portion;

(d) skipping part of the motion from the cam and resetting the engine valve lift to a predetermined profile;

(e) disengaging said hydro-mechanical reset mechanism after the engine valve lift gets into the its bottom portion;

(f) changing said actuator from the inoperative position back to the operative position to take up said gap and to form the mechanical linkage; and (g) transmitting the remaining part of the motion from the cam to the engine valve.

* * * * *